US007563146B2

(12) United States Patent
Setsuda et al.

(10) Patent No.: US 7,563,146 B2
(45) Date of Patent: Jul. 21, 2009

(54) UNBAKED LAMINATE FOR PRODUCING FRONT PLATE OF PLASMA DISPLAY DEVICE, AND METHOD FOR PRODUCING FRONT PLATE OF PLASMA DISPLAY DEVICE

(75) Inventors: Hitoshi Setsuda, Kanagawa (JP); Akira Kumazawa, Kanagawa (JP); Kiminori Oshio, Kanagawa (JP); Hiroyuki Obiya, Kanagawa (JP)

(73) Assignee: Tokyo Ohka Kogyo Co., Ltd., Kanagawa (JP)

( * ) Notice: Subject to any disclaimer, the term of this patent is extended or adjusted under 35 U.S.C. 154(b) by 465 days.

(21) Appl. No.: 10/526,491

(22) PCT Filed: May 26, 2004

(86) PCT No.: PCT/JP2004/007549

§ 371 (c)(1),
(2), (4) Date: Mar. 4, 2005

(87) PCT Pub. No.: WO2004/107379

PCT Pub. Date: Dec. 19, 2004

(65) Prior Publication Data

US 2005/0271982 A1 Dec. 8, 2005

(30) Foreign Application Priority Data

May 28, 2003 (JP) ..... 2003-150304

(51) Int. Cl.
*H01J 9/24* (2006.01)
*H01J 9/26* (2006.01)
*H01J 17/49* (2006.01)

(52) U.S. Cl. ..... 445/24; 445/25; 313/587

(58) Field of Classification Search ..... 430/321, 430/288.1; 264/614; 445/24–25; 313/582–587
See application file for complete search history.

(56) References Cited

U.S. PATENT DOCUMENTS

| | | | | |
|---|---|---|---|---|
| 5,919,569 | A * | 7/1999 | Obiya et al. | 428/423.7 |
| 6,039,622 | A * | 3/2000 | Kosaka et al. | 445/52 |
| 6,207,268 | B1 * | 3/2001 | Kosaka et al. | 428/325 |
| 6,825,140 | B2 * | 11/2004 | Saegusa et al. | 501/15 |
| 2001/0017520 | A1 | 8/2001 | Masuda et al. | |
| 2002/0034611 | A1 * | 3/2002 | Masuko et al. | 428/168 |
| 2002/0163108 | A1 * | 11/2002 | Oshio et al. | 264/614 |

(Continued)

FOREIGN PATENT DOCUMENTS

EP 1 150 322 A1 10/2001

(Continued)

*Primary Examiner*—Sikha Roy
*Assistant Examiner*—Anne M Hines
(74) *Attorney, Agent, or Firm*—Wenderoth, Lind & Ponack, LLP.

(57) ABSTRACT

The present invention provides an unbaked laminate for producing a front plate (1) of a plasma display device, and a method for producing such a front plate (1). The laminate includes a burnable intermediate layer (14), and may include an unbaked dielectric layer (12A) and a photosensitive unbaked spacer material layer (16A). The burnable intermediate layer (14) positions between the dielectric layer (12) and the spacer material layer (16), and may burn up upon baking treatment, enabling removal of residues of the spacer material layer in the region subjected to its removal.

14 Claims, 9 Drawing Sheets

U.S. PATENT DOCUMENTS

| | | | | |
|---|---|---|---|---|
| 2002/0164542 | A1* | 11/2002 | Oshio et al. | 430/270.1 |
| 2003/0071572 | A1* | 4/2003 | Hibino et al. | 313/586 |
| 2003/0087179 | A1* | 5/2003 | Iwasaki | 430/166 |

FOREIGN PATENT DOCUMENTS

| | | | |
|---|---|---|---|
| JP | 8-54734 | | 2/1996 |
| JP | 10-188825 | | 7/1998 |
| JP | 10-188828 | | 7/1998 |
| JP | 10-310453 | | 11/1998 |
| JP | 10-338547 | | 12/1998 |
| JP | 2001-6536 | | 1/2001 |
| JP | 2001-035366 | | 2/2001 |
| JP | 2002-150949 | A | 5/2002 |
| JP | 2002-328467 | | 11/2002 |
| JP | 2002-328470 | | 11/2002 |
| JP | 2002-333715 | | 11/2002 |
| WO | 2004/107049 | | 12/2004 |

* cited by examiner

PRIOR ART

UNBAKED LAMINATE FOR PRODUCING FRONT PLATE OF PLASMA DISPLAY DEVICE, AND METHOD FOR PRODUCING FRONT PLATE OF PLASMA DISPLAY DEVICE

FIELD OF ART

The present invention relates to an unbaked laminate for producing a front plate of a plasma display device having a glass substrate with electrodes formed on its surface, a dielectric layer formed on the glass substrate, and a patterned spacer layer on the dielectric layer. The present invention also relates to a method for producing a front plate of a plasma display device.

BACKGROUND ART

A plasma display device ("PDP"), which displays an image by causing a number of fine cells to emit light by themselves utilizing an electric discharge phenomenon, has excellent features that cannot be realized by conventional display devices, such as a large and thin size, light weight, and flat shape, which is becoming widespread.

Most of conventional plasma display devices employ cells having a straight structure in which ribs are formed only in the vertical direction on the display surface. However, for efficiently introducing light to the front of the plasma display device, there have recently been developed cells having a waffle structure in which ribs are formed not only in the vertical direction but also in the horizontal direction. With the cells having such a waffle structure, leakage of light from the adjacent cells is prevented, enabling an extremely efficient introduction of light to the front.

FIG. 1 is an exploded perspective view of an essential portion of a plasma display device having waffle cells. The plasma display device includes a front plate 1 having combined electrodes 11 formed in parallel to one another wherein each combined electrode is made of a transparent electrode 110 and a bus electrode 112, and a back plate 2 having address electrodes 21 formed in parallel to one another in the cross direction with respect to the combined electrodes 11. The front plate 1 and the back plate 2 are disposed so as to face each other and unified to constitute a display element. The front plate 1 has a transparent glass substrate 10 as a display plane, and the combined electrodes 11 are disposed on the inner side of the glass substrate 10, namely, on the side thereof facing the back plate 2. A dielectric layer 12 is formed so as to cover the combined electrodes 11, and a patterned spacer layer 16 is provided on the dielectric layer 12. A protective layer 19 made of, for example, MgO is formed on the surface of the dielectric layer 12 and the spacer layer 16. On the other hand, the back plate 2 has a substrate 20, which is provided with the address electrodes 21 disposed on a side of the substrate 20 facing the front plate 1. A dielectric layer 22 is formed so as to cover the address electrodes 21, and the light emitting portions are formed on the dielectric layer 22 as described below.

The light emitting portions consist of a number of cells each of which is located in a space at which the combined electrode 11 crosses the address electrode 21. Each cell is confined by ribs 24 formed on the dielectric layer 22 along the vertical and horizontal directions of the display (i.e., the direction indicated by arrows V and H, respectively shown in FIG. 1). A fluorescent layer 26 is provided so as to cover the sidewall of the rib 24 and the surface of the dielectric layer 22 in the rib, that is, the inner wall and bottom of each cell. In the plasma display device, a predetermined voltage from an alternating power source is applied to the combined electrodes of the front plate to form an electric field between the electrodes, so that an electric discharge occurs in the cells. This discharge results in generation of an ultraviolet light, which further causes light emission of the fluorescent layer 26.

FIG. 2 is a perspective view of the front plate 1 of the plasma display device having waffle cells, as seen from the back plate side. FIG. 3 is a cross-sectional view of the plasma display device having waffle cells. As shown in FIG. 2, in the plasma display device having the waffle structure, a number of spacer layers 16 are provided on the dielectric layer 12 so that they are arranged in a form of equally spaced lines. As shown in FIG. 3, in the front plate 1, the spacer layer 16 is in contact with the rib 24. A gap X is thus formed at the upper portion of each cell surrounded by the rib 24, and a rare gas can be introduced to each cell through the gap X.

A process for producing such a front plate is roughly classified into a production process utilizing a screen printing method and a production process utilizing a photolithography method.

In the production process utilizing a screen printing method, a glass paste layer is formed on the glass substrate 10 and baked at 500 to 700° C. to form the dielectric layer 12. On the dielectric layer 12, a glass paste composition is then stacked in a patterned form by screen printing, and further baked at 500 to 700° C. to form the spacer layer 16.

However, the production process utilizing the screen printing method has problems of the cost for production due to the essential two baking steps, as well as a poor precision of the pattern alignment.

Referring to FIG. 10, the production process utilizing a photolithography method is then described. On the glass substrate 10 are formed an unbaked dielectric layer 12A consisting of a non-photosensitive glass paste layer, as well as a photosensitive, unexposed unbaked spacer material layer 16A consisting of a photosensitive glass paste layer. The spacer material layer 16A is then irradiated with, e.g., an ultraviolet light through a photomask 3 (FIG. 10A). The layer is then developed so that a resist pattern 16A' appears (FIG. 10B). The resultant product is baked at 500 to 700° C. to form the dielectric layer 12 and the spacer layer 16 simultaneously (FIG. 10C).

In the production process utilizing a photolithography method, the dielectric layer 12 and the spacer layer 16 can be baked at the same time in a single baking operation, and therefore the cost for production can be advantageously lowered, as compared to the cost for the production process utilizing a screen printing method.

However, upon appearance of the resist pattern after the development treatment in such a production process, the spacer material often remains in regions other than the regions in which the material should be left as a spacer layer (see FIG. 10B). Although the spacer material residue A remaining in the region that has been subjected to the removing development (concave region) becomes somehow flat due to melting of the glass frit component in the baking treatment, it causes unevenness of the exposed surface of the dielectric layer 12, leading to a problem that the thickness of the dielectric layer 12 between the spacer layers 16 becomes ununiform (see FIG. 10C).

As shown in FIG. 3, in the plasma display device, the light emitting portions are disposed between the spacer layers 16. When the thickness of the dielectric layer 12 at that portion is not uniform, the light transmittance or electric discharge properties become ununiform, which can be one of the reason for causing distortion in the image.

DISCLOSURE OF THE INVENTION

The present invention has been made in view of the above-mentioned problems accompanying the prior art. An object of the present invention is therefore to provide a material with which a front plate of a plasma display device having uniform discharge properties and light transmittance can be produced, and a method for producing the same.

The present inventors have conducted extensive studies with a view toward solving the problems described above. As a result, they have obtained the following findings.

That is, the removal of the aforementioned spacer material residue may be achieved by intercalating an intermediate layer between an unbaked dielectric layer and a spacer material layer formed thereon before the baking treatment, wherein the intermediate layer is made of a material which is soluble in or swellable with water or an aqueous solution for development and is burnable by a baking treatment, and then performing the conventional exposure treatment and subsequent treatments. Since the intermediate layer burns up in the baking treatment, a laminate structure which is the same as the conventional laminate structure can be obtained after the baking treatment.

In addition, it has also been found out that layers having a uniform thickness and an excellent surface flatness can be produced by preliminary forming the upper and the lower two or three layers including the intermediate layer on a removable support film, and transferring the resultant laminate on a substrate.

The present invention has been achieved based on the finding described above. In summary, the unbaked laminate for producing a front plate of a plasma display device of the present invention is characterized in that on a removable support film is formed any one of the following combinations (i) to (iii):

(i) a burnable intermediate layer and an unbaked dielectric layer;

(ii) a spacer material layer and a burnable intermediate layer; and (iii) a spacer material layer, a burnable intermediate layer, and an unbaked dielectric layer.

That is, according to the present invention, there is provided an unbaked laminate for producing a front plate of a plasma display device having a glass substrate having a surface on which electrodes are formed, a dielectric layer formed on the surface, and spacer layers formed on the dielectric layer, the laminate including: a removable support film; a burnable intermediate layer formed on the removable support film, the intermediate layer being water-soluble or water-swellable; and an unbaked dielectric layer formed on the burnable intermediate layer, the dielectric layer consisting of a glass paste material.

According to the present invention, there is also provided an unbaked laminate for producing a front plate of a plasma display device having a glass substrate having a surface on which electrodes are formed, a dielectric layer formed on the surface, and spacer layers formed on the dielectric layer, the laminate including: a removable support film; a photosensitive unbaked spacer material layer formed on the removable support film; and a burnable intermediate layer formed on the spacer material layer, the intermediate layer being water-soluble or water-swellable.

According to the present invention, there is further provided an unbaked laminate for producing a front plate of a plasma display device having a glass substrate having a surface on which electrodes are formed, a dielectric layer formed on the surface, and spacer layers formed on the dielectric layer, the laminate including: a removable support film; a photosensitive unbaked spacer material layer formed on the removable support film; a burnable intermediate layer formed on the spacer material layer, the intermediate layer being water-soluble or water-swellable; and an unbaked dielectric layer formed on the burnable intermediate layer, the dielectric layer consisting of a glass paste material.

According to the present invention, there is further provided a method for producing a front plate of a plasma display device having a glass substrate having a surface on which electrodes are formed, a dielectric layer formed on the surface, and spacer layers formed on the dielectric layer, the method including the steps of: (a) forming on the surface of the substrate an unbaked dielectric layer consisting of a glass paste material, a burnable intermediate layer which is water-soluble or water-swellable, and a photosensitive unbaked spacer material layer in this order; (b) irradiating the spacer material layer with a patterning light, and developing the spacer material layer, to constitute a patterned spacer material layer; (c) baking the unbaked dielectric layer, the burnable intermediate layer, and the patterned spacer material layer simultaneously, to burn up the burnable intermediate layer and forming the dielectric layer and the spacer layer on the glass substrate simultaneously.

As used herein, "unbaked laminate for producing a front plate of a plasma display device" refers to a laminate used in the production of a front plate of a plasma display device, having a removable support film and the aforementioned layers formed thereon which are to be transferred and attached to a glass substrate while peeling the removable support film off the layers.

As used herein, the "unbaked" laminate or layer refers to a laminate or layer which is capable of being transformed by baking treatment to be a laminate or layer used in the plasma display device. For example, the unbaked dielectric layer is capable of being transformed by baking treatment to be a dielectric layer of the plasma display device; and the unbaked spacer material layer is capable of being transformed by baking treatment to be a spacer layer of the plasma display device.

In the production of the front plate of the plasma display device with the unbaked laminate of the present invention, the water-soluble or water-swellable, burnable intermediate layer is positioned between the unbaked dielectric layer and the spacer material layer. When the spacer material layer is irradiated with a patterning light and developing the spacer material layer to constitute a patterned spacer material layer, a residue of the spacer material remains on the exposed surface of the burnable intermediate layer between the projecting portions of the pattern. However, with use of the unbaked laminate of the present invention, a residue of the spacer material is formed on the surface of the burnable intermediate layer, hence the spacer material residue may be removed by a developer (water or aqueous solution), so that the spacer layer material can be readily prevented from remaining in the region that has been subjected to the removing development.

In the unbaked laminate for producing a front plate of a plasma display device of the present invention, it is preferred that the surface on the other side of the removable support film is protected by a removable protective film.

It is preferred that the spacer material layer is a water-developable (i.e., capable of being developed by use of water) photosensitive glass paste layer. It is preferred that the burnable intermediate layer contains at least one resin selected from the group consisting of polyvinyl alcohol, a polyvinyl alcohol derivative, and water-soluble cellulose, and has a thickness of 5 micrometers or less.

The method for producing a front plate of a plasma display device of the present invention includes: laminating, on the surface of a glass substrate on which electrodes are formed, an unbaked dielectric layer made of a glass paste material, a burnable intermediate layer which is water-soluble or water-swellable, and an unexposed, photosensitive unbaked spacer material layer in this order from the lowest; irradiating the spacer material layer with a patterning light, and developing the spacer material layer to constitute a patterned spacer material layer; and baking the unbaked dielectric layer, the burnable intermediate layer, and the patterned spacer material layer on the glass substrate simultaneously to permit the burnable intermediate layer to burn up, forming the dielectric layer and the spacer layer on the glass substrate simultaneously.

In the method for producing a front plate of a plasma display device of the present invention, it is preferred to use the unbaked laminate of the present invention for forming the burnable intermediate layer, unbaked dielectric layer, and/or spacer material layer on the glass substrate. That is, lamination of the burnable intermediate layer, unbaked dielectric layer, and/or spacer material layer on the glass substrate may preferably be performed by forming these layers on a removable support film, followed by transfer of these layers to the glass substrate while peeling the removable support film off the layers.

In the method for producing a front plate of a plasma display device of the present invention, the use of the unbaked laminate of the present invention for placing the layers on the glass substrate may result in uniform thickness and excellent surface flatness of the layers.

BRIEF DESCRIPTION OF THE DRAWINGS

In FIG. 4 et seq., numeral 18 denotes a removable film, collectively refers to a support film and a protective film.

BEST MODE FOR CARRYING OUT THE INVENTION

Figure 1:
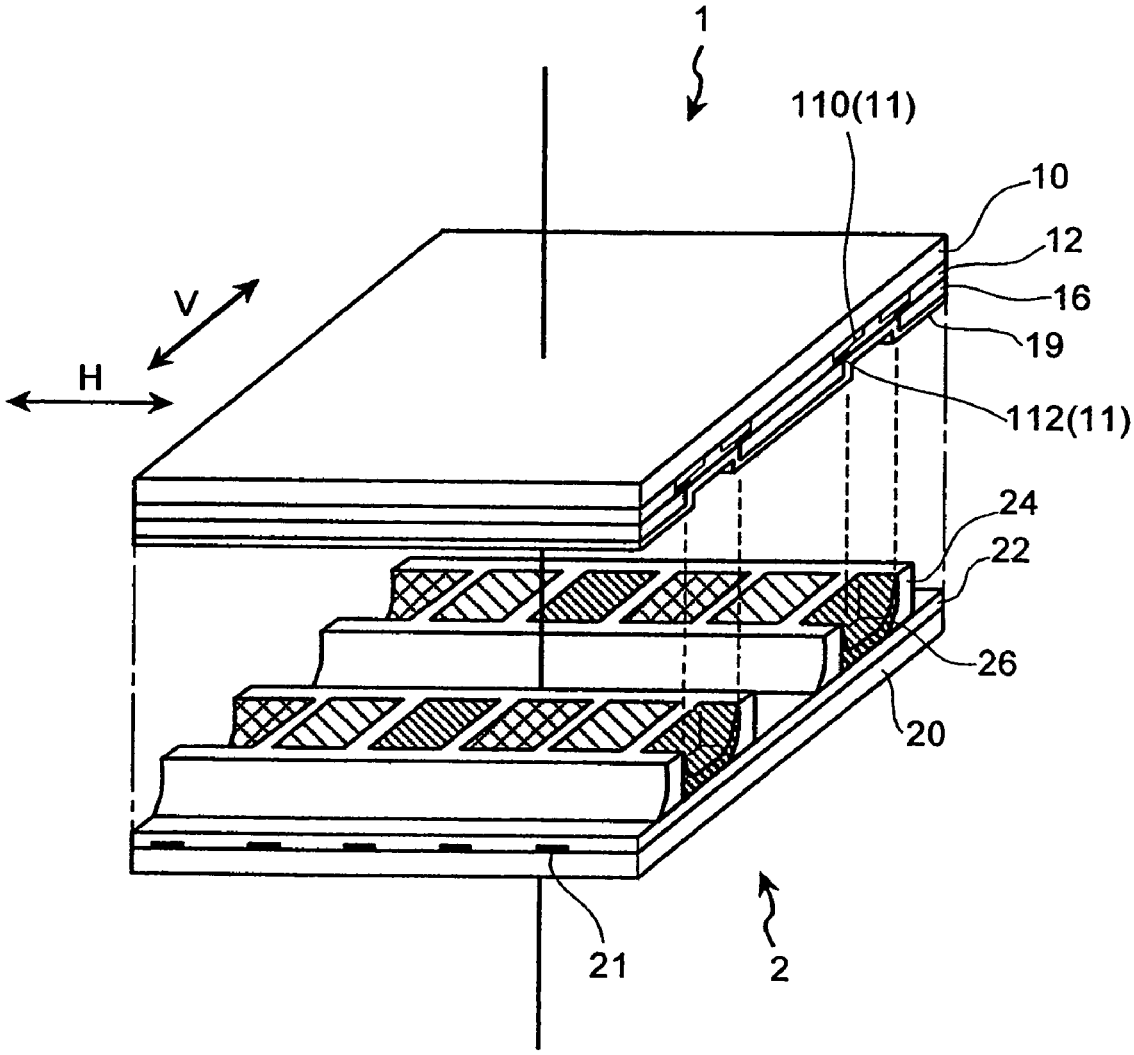
FIG. 1 is an exploded perspective view showing a plasma display device having waffle cells.
Figure 2:
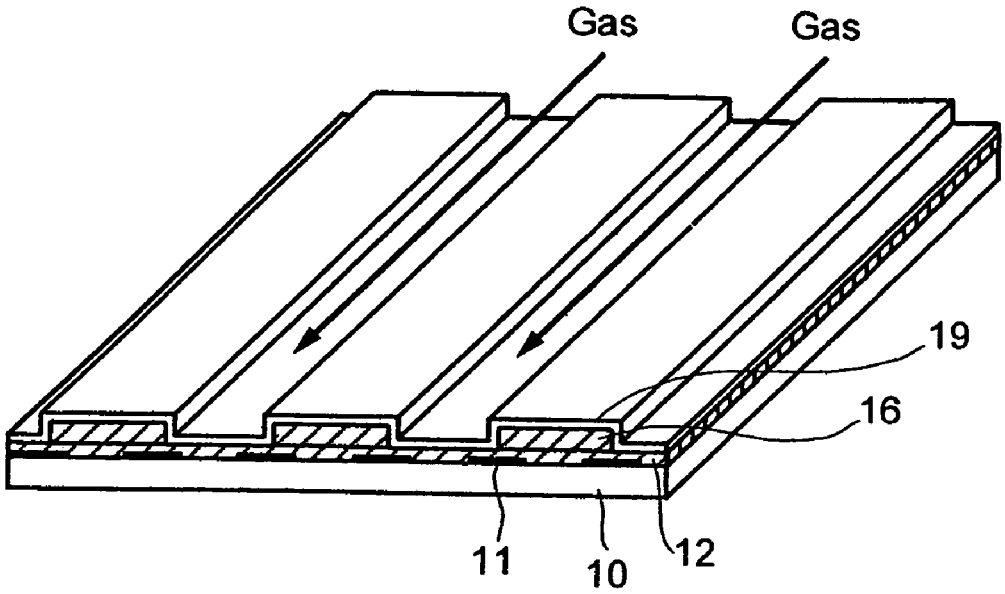
FIG.2 PRIOR ART
FIG. 2 is a perspective view showing a front plate of the plasma display device as seen from the back plate side.
Figure 3:
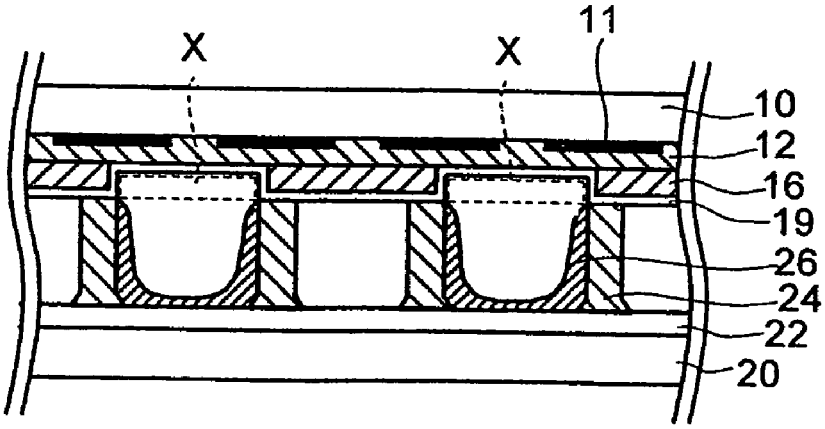
FIG.3 PRIOR ART
FIG. 3 is a cross-sectional view showing the plasma display device having waffle cells.

Typical embodiments of the unbaked laminate of the present invention may include a bilayer structure having a burnable intermediate layer and any one of an unexposed, photosensitive unbaked spacer material layer and an unbaked dielectric layer; as well as a trilayer laminate structure having an unbaked dielectric layer, a burnable intermediate layer, and an unexposed, photosensitive unbaked spacer material layer. It is preferable that the laminate having the bilayer or trilayer structure has readily removable films for covering both surfaces of the laminate, to facilitate storage, transportation, and handling.

Since the unbaked laminate of the present invention can be preliminarily produced and stored for a period of time, it can be immediately used upon producing a front plate of a plasma display device, making it possible to improve the efficiency of production of the front plate of a plasma display device. The essential and most important feature of the unbaked laminate resides in that the laminate has a burnable intermediate layer. The burnable intermediate layer is water-soluble or water-swellable, and further has properties such that it burns up completely in a baking treatment.

In the production of a front plate of a plasma display device, the burnable intermediate layer is located between the unbaked dielectric layer and the spacer material layer as will be described in detail below in connection with the production method. When the spacer material layer in such a laminate is irradiated with a patterning light and developed to constitute a patterned spacer material layer, a residue of the spacer material remains on the exposed surface of the burnable intermediate layer between the projecting portions of the pattern as described above in connection with the conventional technology. In a conventional production method, the spacer material residue remains as such, and melts in a burning treatment to cause unevenness of the exposed surface of the dielectric layer, which should be a uniform and flat surface. By contrast, when using the unbaked laminate of the present invention, a residue of the spacer material is formed on the surface of the burnable intermediate layer. If the burnable intermediate layer is water-soluble, the spacer material residue is washed away by a developer (water or aqueous solution), together with the burnable intermediate layer in the exposed region. If the burnable intermediate layer is water-swellable, it is swollen with a developer to allow the spacer material residue present on the surface of the burnable intermediate layer to leave the surface, so that the residue can be easily removed by the developer.

The burnable intermediate layer, which has facilitated removal of the spacer material residue by a developer as mentioned above and has completed its role, burns up completely in a baking treatment for baking the unbaked dielectric layer and the unbaked spacer material layer. Consequently, a dielectric layer and a spacer layer having the same construction and size as those of the conventional layers are formed on a glass substrate of a front plate. A difference between the resultant front plate and the conventional front plate resides in that the exposed surface of the dielectric layer between the spacer layer and the adjacent spacer layer is conventionally uneven, whereas, in the front plate produced by the present invention, the exposed surface is flat. This is an extremely remarkable effect obtained by the unbaked laminate of the present invention having a water-soluble or water-swellable, burnable intermediate layer as a constituent.

The construction of each layer of the unbaked laminate of the present invention will be described hereinbelow, and then the method for producing a front plate of a plasma display device using the unbaked laminate of the present invention will be described in detail.

[A] Unbaked Laminate

Figure 4A:
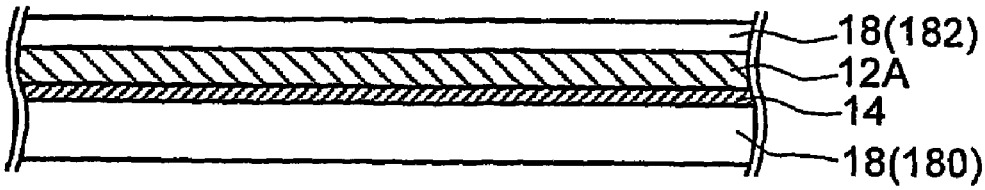
FIGS. 4A to 4C are cross-sectional views showing typical embodiments of the unbaked laminates for producing a front plate of a plasma display device of the present invention.

FIG. 4 are cross-sectional views of typical embodiments of the unbaked laminates of the present invention. FIG. 4A is an example of a bilayer laminate structure including a burnable intermediate layer and an unbaked dielectric layer. In FIG. 4A, reference numeral 180 designates a peelable support film, and a burnable intermediate layer 14 is formed on the support film. On the burnable intermediate layer 14, an unbaked dielectric layer 12A made of a glass paste material is formed, and covered with a protective film 182 as a protective layer.

Figure 4B:
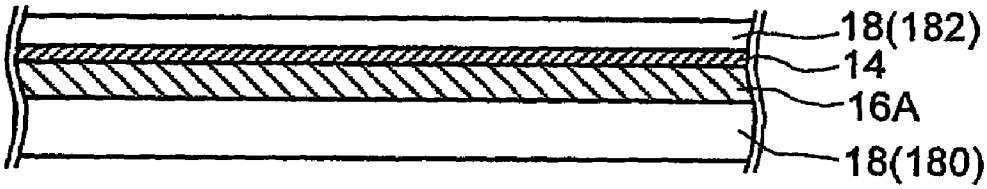

FIG. 4B is an example of a bilayer laminate structure comprising a spacer material layer and a burnable intermediate layer. In FIG. 4B, an unexposed, photosensitive unbaked spacer material layer 16A is formed on the peelable support film 180. On the spacer material layer 16A, a water-soluble or water-swellable, burnable intermediate layer 14 is formed, and covered with the protective film 182 as a protective layer.

Figure 4C:
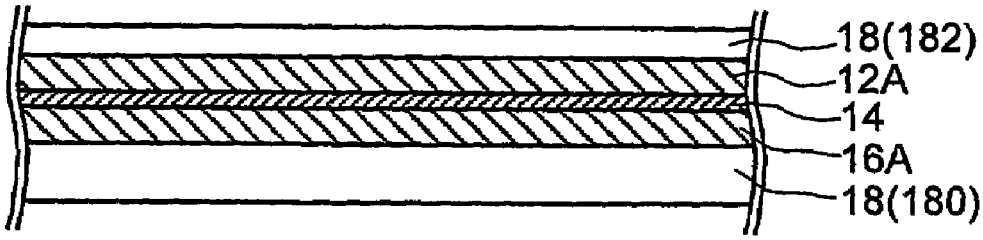

FIG. 4C is an example of a trilayer laminate structure comprising a spacer material layer, a burnable intermediate layer, and an unbaked dielectric layer. In FIG. 4C, the unexposed, photosensitive unbaked spacer material layer 16A is formed on the peelable support film 180. On the spacer material layer 16A, the water-soluble or water-swellable, burnable intermediate layer 14 is formed. On the burnable intermediate layer 14, the unbaked dielectric layer 12A is formed. The surface of the unbaked dielectric layer 12A is protected by the protective film 182.

(a) Burnable Intermediate Layer

The burnable intermediate layer 14 is a layer which is water-soluble or water-swellable. The burnable intermediate layer may be dissolved or swollen by washing with water to allow the unbaked spacer material layer remaining in the region that has been subjected to the removing development to leave the surface, thereby removing such a residue.

With respect to the burnable intermediate layer 14, there is no particular limitation as long as it is water-soluble or water-swellable and decomposes or burns up by the baking treatment. The baking treatment for decomposing or burning up the intermediate layer may be carried out at 500 to 700° C. The intermediate layer may preferably include at least either one of a water-soluble resin and a water-swellable resin. It is preferred that the burnable intermediate layer is formed using a composition for forming the burnable intermediate layer, which includes at least either one of a water-soluble resin and a water-swellable resin, and a solvent.

(i) Water-soluble Resin or Water-swellable Resin

As the water-soluble resin, polyvinyl alcohol, a polyvinyl alcohol derivative, or water-soluble cellulose may preferably be used. As the water-swellable resin, one obtained by partially crosslinking the above water-soluble resin may be used. These resins may be used individually or in combination.

Specific examples of the polyvinyl alcohol derivative may include silanol-modified polyvinyl alcohol, cation-modified polyvinyl alcohol, mercapto group-containing polyvinyl alcohol, and butyral resins.

Specific examples of the water-soluble resin may include carboxymethyl cellulose, hydroxymethyl cellulose, hydroxyethyl cellulose, hydroxyethyl methyl, cellulose, hydroxypropyl cellulose, ethyl hydroxyethyl cellulose, carboxymethyl ethyl cellulose, and hydroxypropyl methyl cellulose.

Among these, polyvinyl alcohol and hydroxymethyl cellulose are particularly preferred from the viewpoint of obtaining excellent water solubility, heat decomposability, and solvent resistance (resistance of the dielectric layer against the solvent).

(ii) Solvent

The solvent for forming the burnable intermediate layer may preferably be a solvent in which the water-soluble resin or water-swellable resin is readily soluble. The solvent may preferably be capable of giving a viscosity suitable for application to the composition, and being easily removed from the layer by drying evaporation. Examples of the solvent may include water, and an organic solvent, such as isopropyl alcohol.

(iii) Formation of Burnable Intermediate Layer

The burnable intermediate layer may be formed by diluting the water-soluble resin or water-swellable resin with a solvent so as to have a concentration suitable for application, applying the resulting composition to a surface for forming a layer, and then drying the layer for removing the solvent.

The content of the water-soluble resin or water-swellable resin in the burnable intermediate layer composition for forming the burnable intermediate layer may preferably be 50% by weight or less, more preferably 30% by weight or less, and the most preferably 0.1 to 20% by weight.

The thickness of the burnable intermediate layer may preferably be 20 micrometers or less, more preferably 10 micrometers or less, further preferably 5 micrometers or less. If the burnable intermediate layer is too thick, the pattern in the unbaked spacer material layer is undesirably washed away in the subsequent step of washing with water. The most preferred thickness of the burnable intermediate layer is 0.1 to 3 micrometers.

(b) Unbaked Dielectric Layer

The unbaked dielectric layer 12A consists of a glass paste layer obtained by applying a glass paste composition containing glass frit to a surface for forming a layer, and then drying the layer. When the dielectric layer 12A is subjected to the baking treatment, organic substances therein are removed and the glass frit therein is sintered, resulting in formation of a dielectric layer 12. The glass paste composition for forming the unbaked dielectric layer 12A may contain glass frit, a bonding resin, and a solvent.

(i) Glass Frit

The glass frit to be contained in the glass paste composition may preferably have desired transparency. Examples of the glass frit to be employed may include glass powder of lead borosilicate glass, zinc borosilicate glass, and bismuth borosilicate glass, such as $PbO—SiO_2$, $PbO—B_2O_3—SiO_2$, $ZnO—SiO_2$, $ZnO—B_2O_3—SiO_2$, $BiO—SiO_2$, and $BiO—B_2O_3—SiO_2$.

The particle size of the glass frit used may preferably have an average particle size of 0.1 to 10 micrometers, more preferably 0.5 to 8 micrometers, depending on the shape of the pattern to be configured. When the average particle size of the glass frit is more than 10 micrometers, the surface may be roughened upon forming a fine pattern, thus not being preferable. When the average particle size is less than 0.1 micrometer, small pores may be formed during the baking to cause insulation failure, thus not being preferable. Examples of forms of the glass frit may include a spherical form, a block form, a flake form, a dendrite form, and combinations thereof.

In addition to the glass frit, the unbaked dielectric layer may further contain inorganic powders, such as ceramic (e.g., cordierite) or a metal. Specific examples of inorganic powders may include oxides of Na, K, Mg, Ca, Ba, Ti, Zr, and Al, such as cobalt oxide, iron oxide, chromium oxide, nickel oxide, copper oxide, manganese oxide, neodymium oxide, vanadium oxide, cerium oxide tipaque yellow, cadmium oxide, ruthenium oxide, silica, magnesia, and spinel.

When the inorganic powders contain silicon oxide, aluminum oxide, or titanium oxide, such an ingredient may cause the resulting layer to be opaque, which may result in low light transmittance. Therefore, it is desired that the inorganic powders do not contain such an ingredient.

It is also preferred that an inorganic pigment capable of coloring the dielectric layer black, red, blue, or green is added as the inorganic powder to form patterns each having a color so that the dielectric layer functions as a color filter of the plasma display device.

The inorganic powder may be a mixture of a plurality of sorts of particles each having different physical property values from others. Especially when using ceramic powders having a different heat softening point from that of the glass frit, the shrinkage during the burning may be suppressed. The inorganic powder may preferably be prepared by selecting the combination of the form and the physical property values depending on the desired properties of the dielectric layer.

(ii) Bonding Resin

As the bonding resin contained in the glass paste composition, acrylic resins, cellulose derivatives, polyvinyl alcohol, polyvinyl butyral, polyethylene glycol, urethane resins, and melamine resins are known. Preferred are acrylic resins, especially acrylic resins having a hydroxyl group since they exhibit excellent heat adhesion properties to a glass substrate.

Examples of the acrylic resin having a hydroxyl group may include copolymers obtained by polymerizing monomers having a hydroxyl group as a main copolymerizable monomer and, if necessary, other monomers copolymerizable with them. As the monomer having a hydroxyl group, preferred are monoesters of acrylic acid or methacrylic acid and a monoalcohol having 1 to 20 carbon atoms. Examples of the monomer may include hydroxymethyl acrylate, hydroxymethyl methacrylate, 2-hydroxyethyl acrylate, 2-hydroxyethyl methacrylate, 2-hydroxypropyl acrylate, 2-hydroxypropyl methacrylate, 3-hydroxypropyl acrylate, 3-hydroxypropyl methacrylate, 2-hydroxybutyl acrylate, 2-hydroxybutyl methacrylate, 3-hydroxybutyl acrylate, 3-hydroxybutyl methacrylate, 4-hydroxybutyl acrylate, and 4-hydroxybutyl methacrylate. Examples of the monomers may also include monoesters of acrylic acid or methacrylic acid and a glycol having 1 to 10 carbon atoms, and epoxy ester compounds made from glycerol acrylate, glycerol methacrylate, dipentaerythritol monoacrylate, dipentaerythritol monomethacrylate, ϵ-caprolactone-modified hydroxyethyl acrylate, ϵ-caprolactone-modified hydroxyethyl methacrylate, and 2-hydroxy-3-phenoxypropyl acrylate.

Examples of other monomers copolymerizable with the monomer having a hydroxyl group may include α,β-unsaturated carboxylic acids, such as acrylic acid, methacrylic acid, itaconic acid, citraconic acid, maleic acid, and fumaric acid, and anhydrides and half esters thereof; α,β-unsaturated carboxylic acid esters, such as methyl acrylate, ethyl acrylate, n-propyl acrylate, isopropyl acrylate, n-butyl acrylate, isobutyl acrylate, sec-butyl acrylate, cyclohexyl acrylate, 2-ethylhexyl acrylate, stearyl acrylate, methyl methacrylate, ethyl methacrylate, n-propyl methacrylate, isopropyl methacrylate, sec-propyl methacrylate, n-butyl methacrylate, isobutyl methacrylate, sec-butyl methacrylate, cyclohexyl methacrylate, 2-ethylhexyl methacrylate, stearyl methacrylate, 2,2,2-trifluoromethyl acrylate, and 2,2,2-trifluoromethyl methacrylate; and styrenes, such as styrene, α-methylstyrene, and p-vinyltoluene. In addition, acrylonitrile, methacrylonitrile, acrylamide, methacrylamide, vinyl acetate, glycidyl acryalte, and glycidyl methacryalte may be used. These monomers may be used individually or in combination.

(iii) Solvent

The solvent to be contained in the glass paste composition may be a solvent in which the organic component is well soluble. The solvent may suitably selected so that the resulting photosensitive glass paste composition has an appropriate viscosity. It is preferable that the solvent can be easily removed by drying evaporation. Especially preferred examples of solvents may include ketones, alcohols, and esters having a boiling point of 100 to 200° C.

Specific examples of solvents may include ketones, such as diethyl ketone, methyl butyl ketone, dipropyl ketone, and cyclohexanone; alcohols, such as n-pentanol, 4-methyl-2-pentanol, cyclohexanol, and diacetone alcohol; ether alcohols, such as ethylene glycol monomethyl ether, ethylene glycol monoethyl ether, ethylene glycol monobutyl ether, propylene glycol monomethyl ether, propylene glycol monoethyl ether, diethylene glycol monomethyl ether, diethylene glycol monoethyl ether, diethylene glycol dimethyl ether, and diethylene glycol diethyl ether; saturated aliphatic monocarboxylic acid alkyl esters, such as n-butyl acetate and amyl acetate; lactic acid esters, such as ethyl lactate and n-butyl lactate; and ether esters, such as methyl cellosolve acetate, ethyl cellosolve acetate, propylene glycol monomethyl ether acetate, propylene glycol monoethyl ether acetate, ethyl 3-ethoxypropionate, 2-methoxybutyl acetate, 3-methoxybutyl acetate, 4-methoxybutyl acetate, 2-methyl-3-methoxybutyl acetate, 3-methyl-3-methoxybutyl acetate, 3-ethyl-3-methoxybutyl acetate, 2-ethoxybutyl acetate, 4-ethoxybutyl acetate, 4-propoxybutyl acetate, and 2-methoxypentyl acetate. These solvents may be used individually or in combination.

(iv) Formation of Unbaked Dielectric Layer

The unbaked dielectric layer may be formed by forming a layer of the glass paste composition, and then drying the layer to remove the solvent.

Preferable ratio of the amount of the inorganic component (the sum of the glass frit and the inorganic particles) and the amount of the organic component (including a bonding resin) is as follows: relative to 100 parts by weight of the sum of the inorganic component and the organic component, the amount of the organic component may be in the range of 5 to 40 parts by weight and the amount of the inorganic component may be in the range of 95 to 60 parts by weight; and it is preferred that the amount of the organic component is in the range of 7 to 35 parts by weight and the amount of the inorganic component is in the range of 93 to 65 parts by weight; and it is further preferred that the amount of the organic component is in the range of 10 to 30 parts by weight and the amount of the inorganic component is in the range of 90 to 70 parts by weight. When the amount of the organic component is less than 5 parts by weight, it may become difficult to form a layer; whereas when the amount of the organic component is more than 40 parts by weight, the shrinkage after the burning may disadvantageously become too large.

For maintaining the viscosity of the glass paste composition in an appropriate range, the amount of the solvent is preferably 300 parts by weight or less, more preferably 10 to 70 parts by weight, and most preferably 25 to 35 parts by weight, relative to 100 parts by weight of the sum of the inorganic component and the organic component.

In addition to the aforementioned components including the glass frit, bonding resin and solvent, the glass paste composition may further contain an arbitrary component as an additive, such as a plasticizer, a dispersant, a tackifier, a surface tension adjuster, a stabilizer, or a defoamer.

The thickness of the unbaked dielectric layer after being dried is preferably 10 to 100 micrometers, and more preferably 25 to 70 micrometers.

(c) Spacer Material Layer

A spacer material layer 16A may consist of a layer of photosensitive glass paste composition. Such a spacer material layer may be produced by forming a layer of the photosensitive glass paste composition on a surface, and drying the layer. As used herein, the spacer material layer refers to a layer which is transformed to be a spacer layer by baking treatments. The spacer material layer 16A may be subjected to photolithography for forming a pattern, and then subjected to baking treatment for removing organic substances and simultaneously sintering glass frit, to form a spacer layer 16.

The photosensitive glass paste composition for forming the spacer material layer may be those having a sufficient transparency to an ultraviolet light, an excimer laser, an X-ray, or an electron beam (these may be referred to hereinbelow as "light") for conducting the exposure treatment. The photosensitive glass paste composition may preferably be those with which a spacer material layer in which a pattern with high precision can be formed by a photolithography method.

Examples of such a photosensitive glass paste composition may include, for example, photosensitive paste compositions disclosed in Japanese Patent Application Laid-open No. 2000-268633, Japanese Patent Application Laid-open No. 2000-53444, Japanese Patent Application Laid-open No. H11-246638, and Japanese Patent Application Laid-open No. 2002-328470.

The photosensitive glass paste composition may preferably be water-developable since the development step for forming the dielectric pattern and the step of washing with water can be conducted simultaneously to simplify the production process. Such a water-developable composition generally has an excellent light transmittance and can maintain high light transmittance even when it contains a large amount of the organic component, which enables pattern formation with high precision in the photolithography.

The photosensitive glass paste composition may contain a resist composition, glass frit, and a solvent. As the glass frit and solvent, the same ones as those used in the glass paste composition described above in the section "(b) Unbaked dielectric layer" may be used.

The resist composition used in the photosensitive glass paste composition may contain a bonding resin, a photopolymerizable monomer, and a photopolymerization initiator.

(i) Bonding Resin

As the bonding resin in the photosensitive glass paste composition, the same one as the bonding resin used in the glass paste composition described above in the section "(b) Unbaked dielectric layer" may be used. Particularly, the photosensitive glass paste composition may preferably contain an acrylic resin having a hydroxyl group and a water-soluble cellulose derivative in combination since such a composition has an improved transmittance of an active light, such as ultraviolet light, an excimer laser, an X-ray, or an electron beam, enabling formation of a pattern with high precision.

As the water-soluble cellulose derivative, one conventionally known may be used without any particular limitation. Examples thereof may include carboxymethyl cellulose, hydroxymethyl cellulose, hydroxyethyl cellulose, hydroxyethyl methyl cellulose, hydroxypropyl cellulose, ethyl hydroxyethyl cellulose, carboxymethyl ethyl cellulose, and hydroxypropyl methyl cellulose.

(ii) Photopolymerizable Monomer

As the photopolymerizable monomer, a conventionally known photopolymerizable monomer may be used without any particular limitation. Examples thereof may include benzyl acrylate, benzyl methacrylate, cyclohexyl acrylate, cyclohexyl methacrylate, phenoxyethyl acrylate, phenoxyethyl methacrylate, phenoxypolyethylene glycol acrylate, phenoxypolyethylene glycol methacrylate, styrene, nonylphenoxypolyethylene glycol monoacrylate, nonylphenoxypolyethylene glycol monomethacrylate, nonylphenoxypolypropylene glycol monoacrylate, nonylphenoxypolypropylene glycol monomethacrylate, 2-hydroxy-3-phenoxypropyl acrylate, 2-acryloyloxyethyl phthalate, 2-acryloyloxyethyl-2-hydroxyethyl phthalate, 2-methacryloyloxyethyl-2-hydroxypropyl phthalate, methyl acrylate, ethyl acrylate, methyl methacrylate, ethyl methacrylate, n-propyl acrylate, n-propyl methacrylate, 2-hydroxyethyl acrylate, 2-hydroxyethyl methacrylate, 2-hydroxypropyl acrylate, 2-hydroxypropyl methacrylate, 3-hydroxypropyl acrylate, 3-hydroxypropyl methacrylate, ethylene glycol monoacrylate, ethylene glycol monomethacrylate, glycerol acrylate, glycerol methacrylate, dipentaerythritol monoacrylate, dipentaerythritol monomethacrylate, dimethylaminoethyl acrylate, dimethylaminoethyl methacrylate, tetrahydrofurfuryl acrylate, tetrahydrofurfuryl methacrylate, phthalic acid-modified monoacrylate, ethylene glycol diacrylate, ethylene glycol dimethacrylate, triethylene glycol diacrylate, triethylene glycol dimethacrylate, trimethylolpropane triacrylate, trimethylolpropane trimethacrylate, trimethylolethane triacrylate, trimethylolethane trimethacrylate, pentaerythritol diacrylate, pentaerythritol dimethacrylate, pentaerythritol triacrylate, pentaerythritol trimethacrylate, pentaerythritol tetraacrylate, pentaerythritol tetramethacrylate, dipentaerythritol tetraacrylate, dipentaerythritol tetramethacrylate, dipentaerythritol pentaacrylate, dipentaerythritol pentamethacrylate, dipentaerythritol hexaacrylate, dipentaerythritol hexamethacrylate, glycerol acrylate, glycerol methacrylate, cardoepoxy diacrylate, and fumaric acid esters corresponding to the above-mentioned compounds in which (meth)acrylate is replaced by fumarate, itaconic acid esters corresponding to the above-mentioned compounds in which (meth)acrylate is replaced by itaconate, and maleic acid esters corresponding to the above-mentioned compounds in which (meth)acrylate is replaced by maleate.

(iii) Photopolymerization Initiator

As the photopolymerization initiator, one generally known may be used. Examples thereof may include benzophenones, benzoins, benzoin alkyl ethers, acetophenones, aminoacetophenones, benzyls, benzyl alkyl ketals, anthraquinones, ketals, and thioxanthones. Specific examples thereof may include 2,4-bis-trichloromethyl-6-(3-bromo-4-methoxy)phenyl-s-triazine, 2,4-bis-trichloromethyl-6-(2-bromo-4-methoxy)phenyl-s-triazine, 2,4-bis-trichloromethyl-6-(3-bromo-4-methoxy)styrylphenyl-s-triazine, 2,4-bis-trichloromethyl-6-(2-bromo-4-methoxy)styrylphenyl-s-triazine, 2,4,6-trimethylbenzoyidiphenylphosphine oxide, 1-[4-(2-hydroxyethoxy)phenyl]-2-hydroxy-2-methyl-1-propan-1-one, 2,4-diethylthioxanthone, 2,4-dimethylthioxanthone, 2-chlorothioxanthone, 1-chloro-4-propoxythioxanthone, 3,3-dimethyl-4-methoxybenzophenone, benzophenone, 1-(4-isopropylphenyl)-2-hydroxy-2-methylpropan-1-one, 1-(4-dodecylphenyl)-2-hydroxy-2-methylpropan-1-one, 4-benzoyl-4'-methyldimethyl sulfide, 4-dimethylaminobenzoic acid, methyl 4-dimethylaminobenzoate, ethyl 4-dimethylaminobenzoate, butyl 4-dimethylaminobenzoate, 2-ethylhexyl 4-dimethylaminobenzoate, 2-isoamyl 4-dimethylaminobenzoate, 2,2-diethoxyacetophenone, benzyl dimethyl ketal, benzyl-β-methoxyethyl acetal, 1-phenyl-1,2-propanedione 2-(o-ethoxycarbonyl)oxime, methyl o-benzoylbenzoate, bis(4-dimethylaminophenyl) ketone, 4,4'-bisdiethylaminobenzophenone, benzyl, benzoin, benzoin methyl ether, benzoin ethyl ether, benzoin isopropyl ether, benzoin n-butyl ether, benzoin isobutyl ether, p-dimethylaminoacetophenone, p-tert-butyltrichloroacetophenone, p-tert-butyldichloroacetophenone, thioxanthone, 2-methylthioxanthone, 2-isopropylthioxanthone, dibenzosuberone, α,α-dichloro-4-phenoxyacetophenone, pentyl 4-dimethylaminobenzoate, and 2-(o-chlorophenyl)-4,5-diphenylimidazolyl dimer. These initiators may be used individually or in combination.

(iv) Formation of Spacer Material Layer

The spacer material layer may be formed by forming a layer of the photosensitive glass paste composition on a surface, and then drying the layer to remove the solvent therein.

Relative to 100 parts by weight of the sum of the water-soluble cellulose derivative and the acrylic resin having a hydroxyl group in the photosensitive glass paste composition, the amount of the water-soluble cellulose derivative may be in the range of 50 to 90 parts by weight and the amount of the acrylic resin having a hydroxyl group may be in the range of 50 to 10 parts by weight; and it is preferred that the amount of the water-soluble cellulose derivative is in the range of 60 to 80 parts by weight and the amount of the acrylic resin having a hydroxyl group is 40 to 20 parts by weight; and it is further preferred that the amount of the water-soluble cellulose derivative is in the range of 60 to 70 parts by weight and the amount of the acrylic resin having a hydroxyl group is 40 to 30 parts by weight.

Relative to 100 parts by weight of the sum of the amount of the water-soluble cellulose derivative and the amount of the photopolymerizable monomer, the amount of the water-soluble cellulose derivative may be in the range of 10 to 50 parts by weight and the amount of the photopolymerizable monomer may be in the range of 90 to 50 parts by weight; and it is preferred that the amount of the water-soluble cellulose derivative is in the range of 20 to 40 parts by weight and the amount of the photopolymerizable monomer is in the range of 80 to 60 parts by weight; and it is further preferred that the amount of the water-soluble cellulose derivative is in the range of 25 to 35 parts by weight and the amount of the photopolymerizable monomer is in the range of 75 to 65 parts by weight.

The amount of the photopolymerization initiator may preferably be used in the range of 0.1 to 10 parts by weight, more preferably in the range of 0.2 to 5 parts by weight, per 100 parts by weight of the sum of the water-soluble cellulose derivative and the photopolymerizable monomer. When the amount of the photopolymerization initiator is less than 0.1 part by weight, the curing properties of the composition may become poor. When the amount of the photopolymerization initiator is more than 10 parts by weight, failure of curing may occur in the bottom due to absorption of the initiator.

Preferable ratio of the amount of the organic component (including a bonding resin such as a water-soluble cellulose derivative or an acrylic resin, and a photopolymerization initiator), and the amount of the inorganic component (the sum of the glass frit and the inorganic particles) is as follows: relative to 100 parts by weight of the photosensitive glass paste composition, the amount of the organic component may be in the range of 10 to 40 parts by weight and the amount of the inorganic component may be in the range of 90 to 60 parts by weight; and it is preferred that the amount of the organic component is in the range of 15 to 35 parts by weight and the amount of the inorganic component is in the range of 85 to 65 parts by weight; and it is further preferred that the amount of the organic component is in the range of 20 to 30 parts by weight and the amount of the inorganic component is in the range of 80 to 70 parts by weight.

The amount of the solvent may preferably be 300 parts by weight or less, more preferably 10 to 70 parts by weight, the most preferably 25 to 35 parts by weight, per 100 parts by weight of the sum of the inorganic component and the organic component, for maintaining the viscosity of the photosensitive glass paste composition in a preferred range.

In addition to the above ingredients, the photosensitive glass paste composition may further contain an additive component, such as an ultraviolet light absorber, a sensitizer, a sensitizing auxiliary, a polymerization inhibitor, a plasticizer, a thickener, an organic solvent, a dispersant, a deformer, or an organic or inorganic anti-precipitation agent.

The thickness of the unexposed, photosensitive unbaked spacer material layer obtained by drying a layer of the photosensitive glass paste composition may be in a range of 10 to 50 micrometers, preferably 15 to 40 micrometers.

(d) Method for Producing an Unbaked Laminate

A support film 180 used in the unbaked laminate of the present invention may be a removable film such that the layers formed on the support film can be easily peeled off therefrom and transferred to a glass substrate. Examples thereof may include flexible films having a thickness of 15 to 125 micrometers consisting of a synthetic resin film, such as polyethylene terephthalate, polyethylene, polypropylene, polycarbonate, or polyvinyl chloride. It is preferred that the support film is treated so as to be removable if necessary for facilitating transfer.

In the formation of the spacer material layer 16A, the burnable intermediate layer 14, and the unbaked dielectric layer 12A on the support film, compositions for forming each of the layers are prepared, and applied to the support film 180 using an applicator, a bar coater, a wired bar coater, a roll coater, or a curtain flow coater. The roll coater is especially preferred since it achieves excellent uniformity in the application thickness and can efficiently form a layer having a satisfactorily large thickness. The layer of the composition applied may be dried and another composition for forming another layer may then be applied to the dried layer. In such a manner, each layer may be laminated, for producing the unbaked laminate of the present invention shown in FIGS. 4A to 4C.

It is preferred that the surface of the unbaked laminate on the other side of the support film 180 is covered with a protective film 182 for stably protecting, for example, the photosensitive paste composition layer before use. The protective film may preferably be a polyethylene terephthalate film, a polypropylene film, or a polyethylene film, having silicone coated or baked thereon and having a thickness of about 15 to 125 micrometers.

[B] Method for Producing a Front Plate of a Plasma Display Device

The method for producing a front plate of a plasma display device of the present invention may include: laminating, on the surface of a glass substrate on which electrodes are formed, an unbaked dielectric layer made of a glass paste material, a burnable intermediate layer which is water-soluble or water-swellable, and an unexposed, photosensitive unbaked spacer material layer in this order from the lowest; irradiating the spacer material layer with a patterning light, and developing the spacer material layer to constitute a patterned spacer material layer; and baking the unbaked dielectric layer, the burnable intermediate layer, and the patterned spacer material layer on the glass substrate simultaneously to permit the burnable intermediate layer to burn up, forming the dielectric layer and the spacer layer on the glass substrate simultaneously.

(a) Formation of Layers on Glass Substrate

Stacking of the burnable intermediate layer, the unbaked dielectric layer, and the spacer material layer on the glass substrate may be performed by any of the conventionally known method, such as an application method or a screen printing method, without any limitation. From the viewpoint of forming layers having uniform thickness and excellent surface flatness, the method for forming the layers using the unbaked laminate of the present invention shown in FIGS. 4A to 4C described above is the most preferred.

Figure 5A:
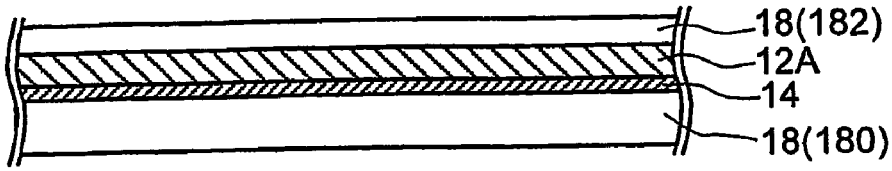
FIGS. 5A to 5D are cross-sectional views showing a process for producing a front plate of a plasma display device using the unbaked laminate for producing a front plate of a plasma display device of FIG. 4A.
Figure 5B:
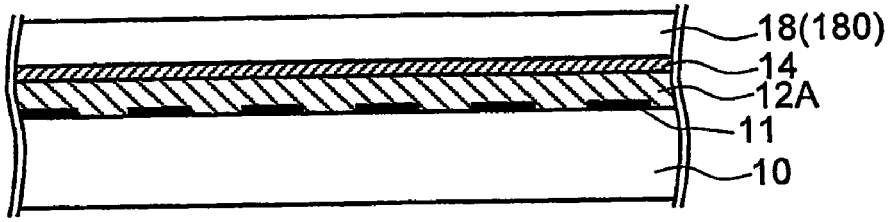
Figure 5C:
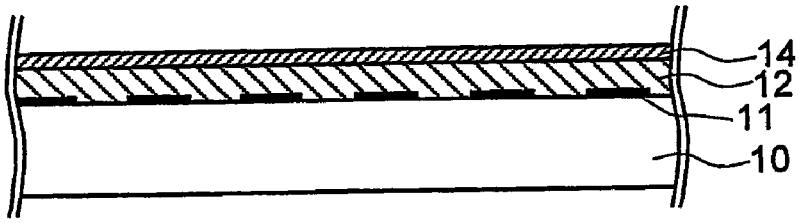
Figure 5D:
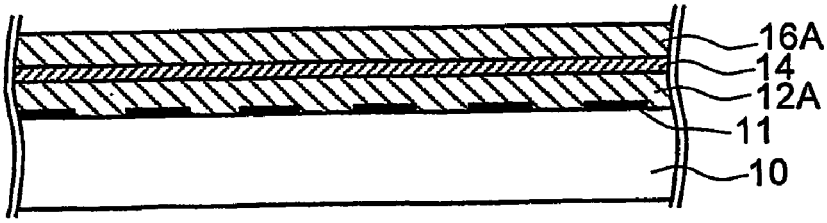
Figure 6:
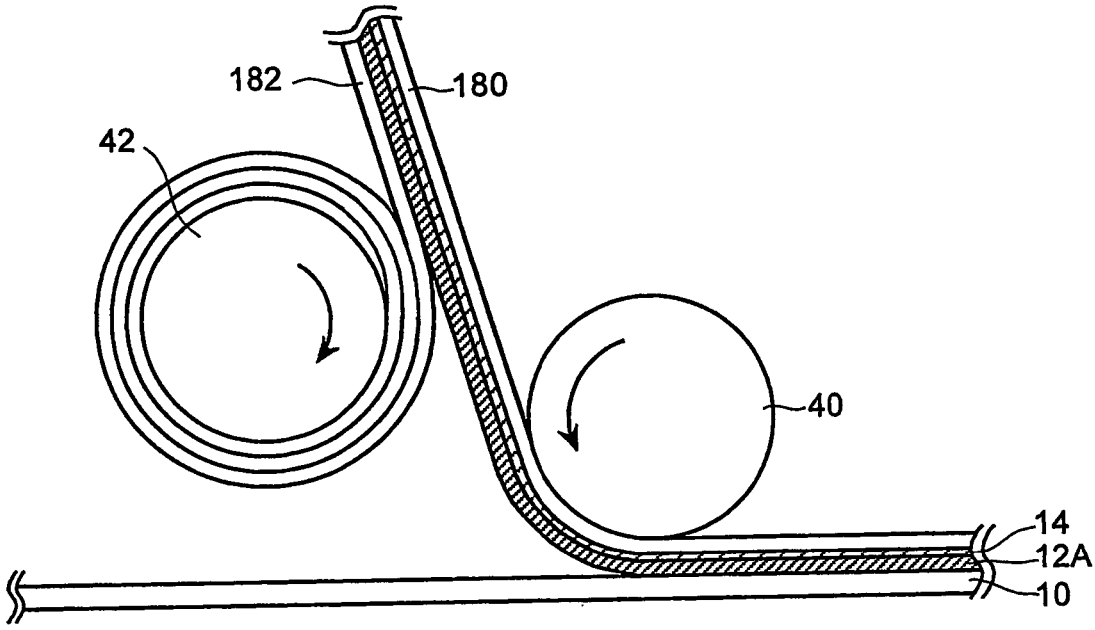
FIG. 6 is a schematic view showing a step of transferring an unbaked dielectric layer 12A and burnable intermediate layer 14 to a glass substrate 10 using the unbaked laminate for producing a front plate of a plasma display device of FIG. 4A.

Referring to FIGS. 5A to 5D and FIG. 6, an example of the process for producing a front plate of a plasma display device using the unbaked laminate shown in FIG. 4A is described. First, the support film 180, burnable intermediate layer 14, unbaked dielectric layer 12A, and protective film 182 are stacked on one another in this order to prepare an unbaked laminate (FIG. 5A). Subsequently, as shown in FIG. 6, while peeling the protective film 182 off, the unbaked laminate is placed on the glass substrate 10 so that the unbaked dielectric layer 12A thus uncovered is in contact with the surface of the glass substrate 10 on which the electrodes 11 are formed, and a heat roller 40 is moved over the support film 180 to hot-press the unbaked dielectric layer 12A and burnable intermediate layer 14 against the surface of the glass substrate (FIG. 5B).

The hot press may preferably be conducted under conditions such that the glass substrate 10 is heated so that the surface temperature becomes 80 to 140° C., the roll pressure is in the range of 1 to 5 kg/cm$^2$, and the moving speed is in the range of 0.1 to 10.0 m/min. The glass substrate may be preheated, and the preheat temperature may be selected in the range of, for example, 40 to 100° C.

The protective film 182 that has been peeled off from the unbaked dielectric layer 12A may successively be taken up by a take-up roller 42 and stored in the form of a roll, which can be reused.

After providing the unbaked dielectric layer 12A and burnable intermediate layer 14 on the surface of the glass substrate 10 by heat-bonding in such a manner (FIG. 5B), the support film 180 is then peeled off from the burnable intermediate layer 14 to uncover the surface of the burnable intermediate layer 14 (FIG. 5C). The support film 180 peeled off from the burnable intermediate layer 14 may also be taken up successively by a take-up roller and stored in the form of a roll, which can be reused.

The spacer material layer 16A is then stacked on the uncovered surface of the burnable intermediate layer 14 (FIG. 5D). Although there is no limitation to the method for stacking the spacer material layer 16A, it is preferred that the spacer material layer is stacked by the same method as the method for forming the burnable intermediate layer or the unbaked dielectric layer. Specifically, it is preferred that the photosensitive glass paste composition is applied to a support film and dried to form the spacer material layer 16A, and the resultant product is stacked on the burnable intermediate layer 14 so that the spacer material layer 16A is in contact with the burnable intermediate layer 14, and a heat roller is moved over the support film to transfer the spacer material layer 16A to the surface of the burnable intermediate layer 14.

Figure 7A:
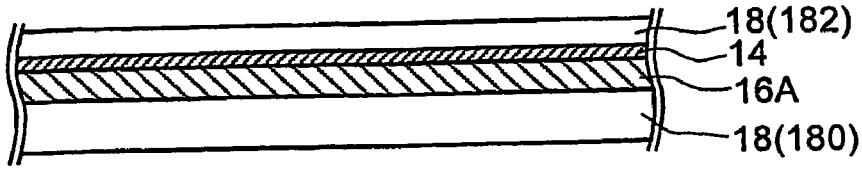
FIGS. 7A to 7D are cross-sectional views showing a process for producing a front plate of a plasma display device using the unbaked laminate for producing a front plate of a plasma display device of FIG. 4B.
Figure 7B:
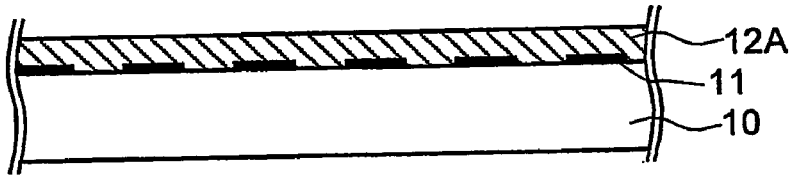
Figure 7C:
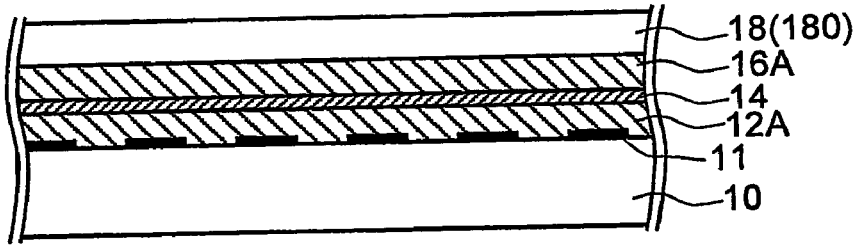
Figure 7D:
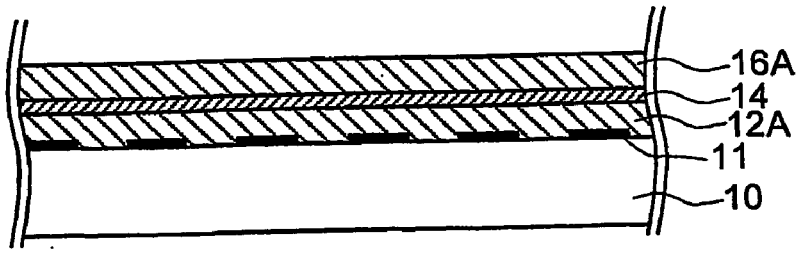

Referring to FIGS. 7A to 7D, an example of the process for producing a front plate of a plasma display device using the unbaked laminate shown in FIG. 4B is then described. First, the support film 180, the spacer material layer 16A, the burnable intermediate layer 14, and the protective film 182 are stacked on one another in this order to prepare an unbaked laminate (FIG. 7A). Separately, the unbaked dielectric layer 12A is formed on the surface of the glass substrate 10 on which the electrodes 11 are formed (FIG. 7B). Although there is no limitation to the method for forming the unbaked dielectric layer 12A, it is preferred that the glass paste composition is applied to a support film and dried to form the unbaked dielectric layer 12A, and the resultant product is stacked on the glass substrate 10 so that the unbaked dielectric layer 12A is in contact with the surface of the glass substrate 10 on which the electrodes 11 are formed, and a heat roller is moved over the support film to transfer the unbaked dielectric layer 12A to the glass substrate 10. The protective film 182 in the unbaked laminate of FIG. 7A is peeled off and the unbaked-laminate burnable intermediate layer 14 is brought into contact with the surface of the unbaked dielectric layer 12A, and the heat roller 40 is moved over the support film 180 to heat-bond the burnable intermediate layer 14 and spacer material layer 16A to the unbaked dielectric layer 12A (FIG. 7C). The support film 180 is then peeled off from the spacer material layer 16A, to form the unbaked dielectric layer 12A, burnable intermediate layer 14, and spacer material layer 16A on the glass substrate 10 (FIG. 7D).

Figure 8A:
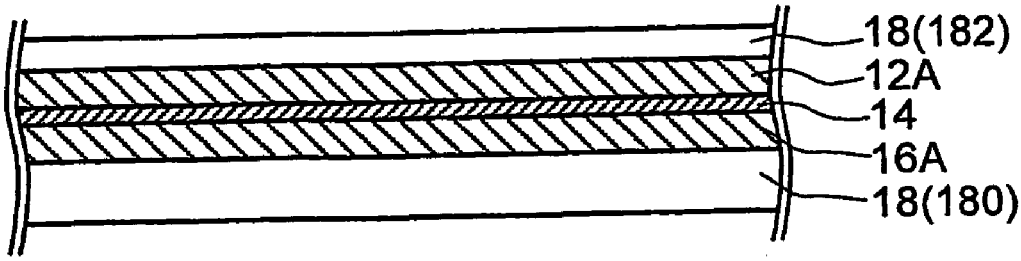
FIGS. 8A to 8C are cross-sectional views showing a process for producing a front plate of a plasma display device using the unbaked laminate for producing a front plate of a plasma display device of FIG. 4C.
Figure 8B:
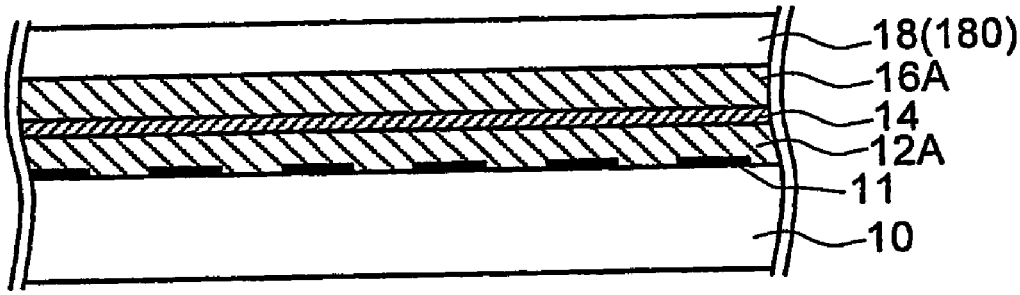
Figure 8C:
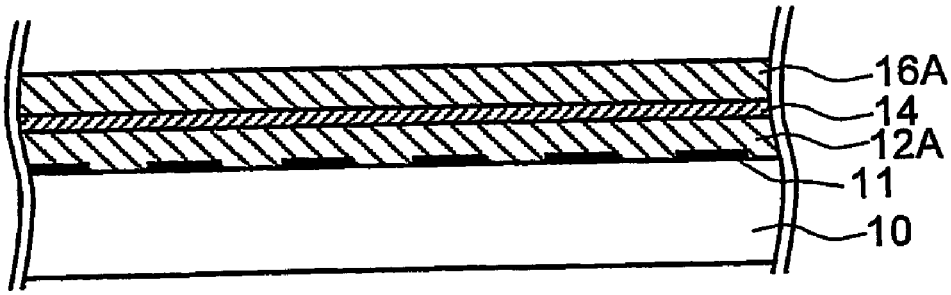

Referring to FIGS. 8A to 8C, an example of the process for producing a front plate of a plasma display device using the unbaked laminate shown in FIG. 4C is then described. First, the support film 180, the spacer material layer 16A, the burnable intermediate layer 14, the unbaked dielectric layer 12A, and the protective film 182 are stacked on one another in this order to prepare an unbaked laminate (FIG. 8A). The protective film 182 in the unbaked laminate is peeled off to uncover the unbaked dielectric layer 12A, and the unbaked dielectric layer 12A is brought into contact with the surface of the glass substrate 10 on which the electrodes 11 are formed, and the heat roller 40 is moved over support film 180 to heat-bond the layers to the surface of the glass substrate (FIG. 8B). The support film 180 is then peeled off from the spacer material layer 16A, to form the unbaked dielectric layer 12A, burnable intermediate layer 14, and spacer material layer 16A on the glass substrate 10 (FIG. 8C).

(b) Exposure and Development Treatment

Figure 9A:
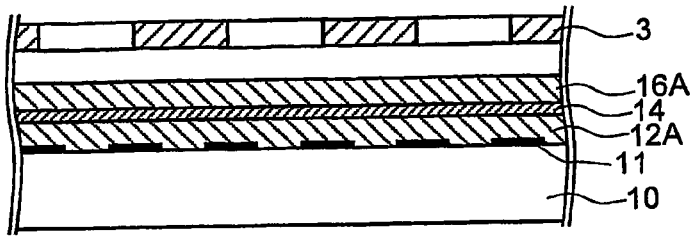
FIGS. 9A to 9D are cross-sectional views showing the exposure, development and baking steps in the method for producing a front plate of a plasma display device of the present invention.

Now referring to FIG. 9A to 9D, an example of the steps of the light exposure and development treatment is described. After forming the unbaked dielectric layer 12A, the burnable intermediate layer 14, and the spacer material layer 16A on a glass substrate in accordance with the method described above, the photomask 3 is placed on the spacer material layer 16A, followed by exposure of the spacer material layer to light, for curing a patterned region of the spacer material layer (FIG. 9A).

When the spacer material layer 16A contains a photosensitive material which hardly undergoes a curing reaction in the presence of oxygen, the exposure may preferably be performed with a transparent film covering the surface of the spacer material layer 16A. For example, when a transparent film is used as the support film 180 of the unbaked laminate of the present invention, the exposure step may preferably be performed after stacking the layers on a glass substrate and before peeling off the support film. That is, the exposure may be performed with the support film 180 covering the spacer material layer 16A, and the support film 180 is then peeled off after completion of the exposure.

The apparatus for irradiation used in the exposure step may include an ultraviolet light irradiation apparatus generally used in a photolithography method, or an exposure system used in the fabrication of semiconductor or liquid crystal display device.

Figure 9B:
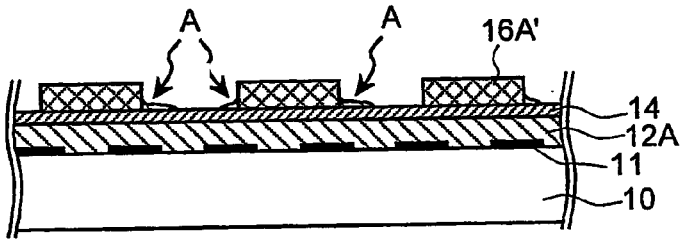

The uncured portion 16A of the spacer material layer is then removed by development, so that the resist pattern 16A' appears (see FIG. 9B).

In the development treatment, a general-purpose alkaline developer or water may be used. Examples of alkali components of the alkaline developer may include hydroxides, carbonates, bicarbonates, phosphates, and pyrophosphates of an alkali metal, such as lithium, sodium, or potassium; primary amines, such as benzylamine and butylamine; secondary amines, such as dimethylamine, dibenzylamine, and diethanolamine; tertiary amines, such as trimethylamine, triethylamine, and triethanolamine; cyclic amines, such as morpholine, piperazine, and pyridine; polyamines, such as ethylenediamine and hexamethylenediamine; ammonium hydroxides, such as tetramethylammonium hydroxide, tetraethylammonium hydroxide, trimethylbenzylammonium hydroxide, and trimethylphenylbenzylammonium hydroxide; trimethylsulfonium hydroxides; sulfonium hydroxides, such as trimethylsulfonium hydroxide, diethylmethylsulfonium hydroxide, and dimethylbenzylsulfonium hydroxide; choline; and silicate-containing buffers. Among the above, water is particularly preferred considering damage caused by the alkali component of frit.

When constituting a patterned spacer material layer, a residue of the spacer material remains on the exposed surface of the burnable intermediate layer between the projecting regions of the pattern (see A in FIG. 9B). In the method of the present invention, the residue A of the spacer material is formed on the surface of the burnable intermediate layer 14.

Figure 9C:
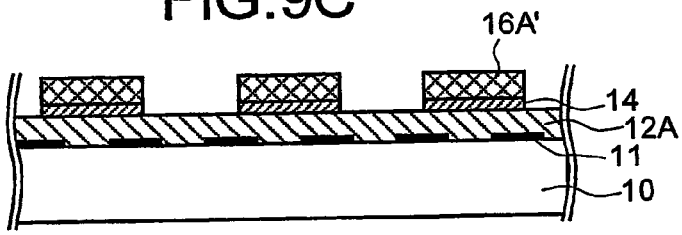
Figure 9C:
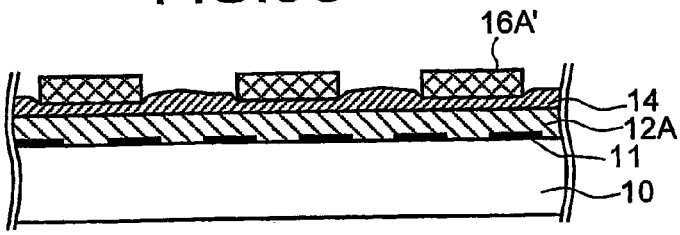

When the burnable intermediate layer 14 is water-soluble, the spacer material residue A is washed away by a developer (water or aqueous solution), together with the burnable intermediate layer in the exposed region as shown in FIG. 9C. When the burnable intermediate layer is water-swellable, the burnable intermediate layer 14 is swollen with a developer as shown in FIG. 9C', to allow the spacer material residue A present on the surface of the burnable intermediate layer to leave the surface, so that the residue can be easily removed by the developer.

In the present invention, the spacer material residue A remaining in the regions in which the spacer material should be removed can be easily washed away in the step of washing the surface with a developer (water or an aqueous solution).

As used herein, the term "washing" means to bring it into contact with a developer (water or an aqueous solution). The method for washing may suitably be selected from any method by which the burnable intermediate layer 14 can be dissolved or swollen to remove the spacer material residue remaining in the region that has been subjected to the removing development. Specific examples of the method for washing may include a dipping method, a rocking method, a shower method, a spraying method, and a paddle method.

(c) Baking

Figure 9D:
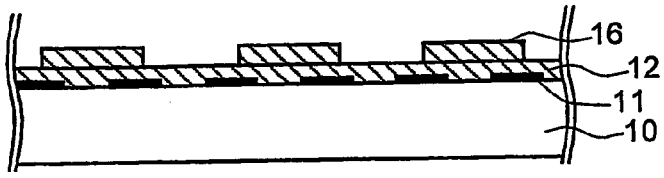
Figure 10A:
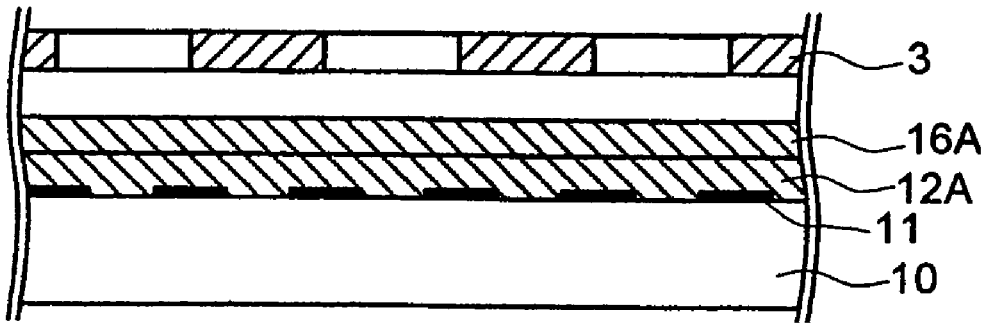
FIG.10A PRIOR ART
FIGS. 10A to 10C are cross-sectional views showing a conventional process for producing a front plate of a plasma display device.
Figure 10B:
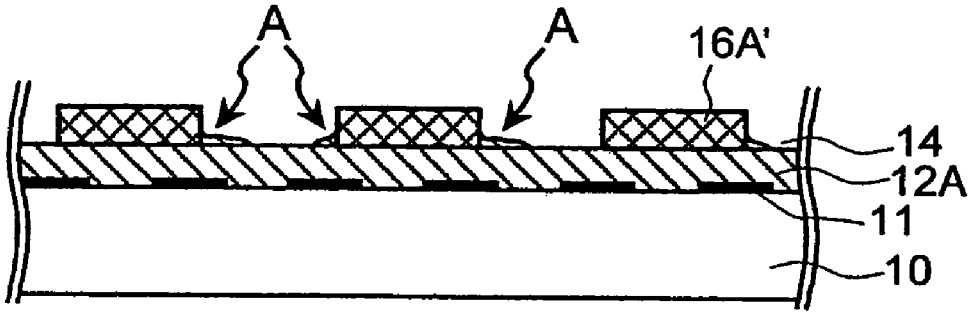
FIG.10B PRIOR ART
Figure 10C:
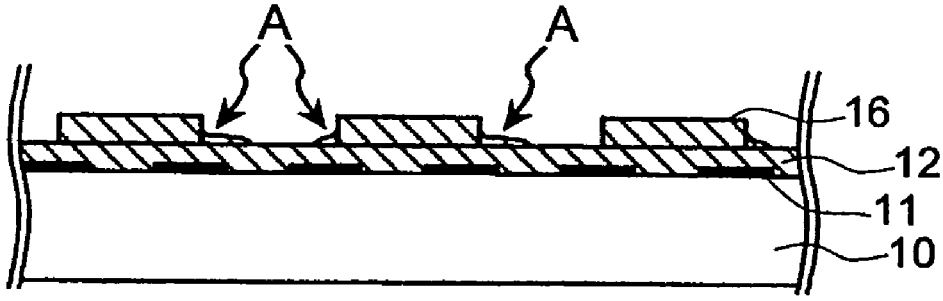
FIG.10C PRIOR ART

When the patterned laminate is baked at 500 to 700° C., the glass frit contained in unbaked dielectric layer 12A and unbaked spacer material layer 16A' is sintered to form the dielectric layer 12 and the spacer layer 16, respectively, thus obtaining the front plate of a plasma display device of the present invention having the patterned spacer layer 16 on the dielectric layer 12 (see FIG. 9D). The organic substances contained in the laminate volatilize or decompose in the baking step, and therefore the burnable intermediate layer 14 does not remain in the laminate after the baking. The front plate usually has a plurality of spacer layers which have a uniform thickness.

After manufacturing the front plate of a plasma display device having a glass substrate with electrodes formed on its surface, a dielectric layer formed on the glass substrate, and a patterned spacer layer on the dielectric layer as described above, the uncovered surface of the dielectric layer and the spacer layer may preferably be covered with a protective layer 19 made of, for example, MgO.

As mentioned above, with the method for producing a front plate of a plasma display device of the present invention, the water-soluble and/or water-swellable, burnable intermediate layer 14 is formed between the unbaked dielectric layer 12A and the unexposed, photosensitive unbaked spacer material layer 16A and, after forming a pattern, a residue of the spacer material layer remaining in the region that is subjected to the removing development can be washed away by the developing liquid, resulting in an improved flatness of the region subjected to the removing development, thus making it possible to produce a front plate of a plasma display device having uniform discharge properties and light transmittance.

EXAMPLES

The present invention will be described with reference to the following Examples, but the Examples are merely working examples for illustrating the present invention and should not be construed as limiting the scope of the present invention. In the following descriptions, Comparative Example is shown together with the Examples.

Example 1

(1) Preparation of Composition for Burnable Intermediate Layer

Four parts by weight of polyvinyl alcohol (Trade name: PVA-235, by Kuraray Co., Ltd.), and 53 parts by weight of water and 43 parts by weight of isopropyl alcohol as a solvent were mixed and stirred by a stirrer for 12 hours to prepare a composition for forming a water-soluble burnable intermediate layer.

(2) Formation of Burnable Intermediate Layer

The obtained composition for forming the burnable intermediate layer was applied to a removable support film made of polyethylene terephthalate (Trade name: Purex A53, by Teijin DuPont Films Japan Limited) using a lip coater, and the resultant layer was dried at 100° C. for 6 minutes to completely remove the solvent, thus forming a burnable intermediate layer having a thickness of 0.5 micrometer on the support film.

(3) Preparation of Glass Paste Composition

20 Parts by weight of an isobutyl methacrylate/hydroxyethyl acrylate=80/20 (wt %) copolymer (Mw: 20,000) as an acrylic resin, 20 parts by weight of 3-methoxy-3-methylbutanol as a solvent, and 80 parts by weight of glass frit were mixed and kneaded to prepare a glass paste composition.

(4) Formation of Unbaked Dielectric Layer

The glass paste composition obtained was applied using a lip coater to the burnable intermediate layer on the support film obtained in (2) above, and the resultant layer was dried at 100° C. for 60 minutes to completely remove the solvent, thus forming an unbaked dielectric layer having a thickness of 60 micrometers on the support film. Removable polyethylene terephthalate film (Trade name: Purex A53, by Teijin DuPont Films Japan Limited) having a thickness of 25 micrometers was then stacked on the unbaked dielectric layer to produce an unbaked laminate for transferring the unbaked dielectric layer and the burnable intermediate layer.

(5) Preparation of Water-Developable Resist Composition

22 Parts by weight of hydroxypropyl cellulose as a water-soluble cellulose derivative, 14 parts by weight of a styrene/hydroxyethyl methacrylate=55/45 (wt %) copolymer (Mw: 40,000) as an acrylic resin, 63 parts by weight of 2-methacryloyloxyethyl 2-hydroxypropyl phthalate (Trade name: HO-MPP, by KYOEISHA CHEMICAL Co., LTD.) as a photopolymerizable monomer, 0.9 part by weight of 2,2-dimethoxy-2-phenylacetophenone (Trade name: IR-651, by Ciba Geigy) as a photopolymerization initiator, 0.1 part by weight of an azo dye (Trade name: Dye SS, by Daito Chemix Corporation) as an ultraviolet light absorber, and 100 parts by weight of 3-methoxy-3-methylbutanol as a solvent were mixed and stirred by a stirrer for 3 hours to prepare a water-developable resist composition.

(5.1) Preparation of Photosensitive Glass Paste Composition

20 Parts by weight of the water-developable resist composition (solid content: 50%) obtained in (5) and 80 parts by weight of glass frit were mixed and kneaded to prepare a water-developable photosensitive glass paste composition.

(6) Formation of Spacer Material Layer

The water-developable photosensitive glass paste composition obtained in (5.1) was applied to a support film made of polyethylene terephthalate using a lip coater, and the resultant layer was dried at 100° C. for 6 minutes to completely remove the solvent, thus forming a spacer material layer having a thickness of 40 micrometers on the support film. A polyethylene film having a thickness of 25 micrometers was then stacked on the spacer material layer to produce an unbaked laminate for transferring the spacer material layer.

(7) Formation of Layers on Glass Substrate

A glass substrate having bus electrodes was preheated to 80° C. On this substrate, the unbaked laminate obtained in (4) was then laminated at 105° C. with a hot roll laminator while peeling off the removable polyethylene terephthalate film (Purex A24), to stack the unbaked dielectric layer and burnable intermediate layer on the glass substrate. The air pressure was 3 kg/cm$^2$, and the lamination speed was 1.0 m/min.

Subsequently, the removable polyethylene terephthalate film (Purex A53) as the support film was peeled off.

The laminate on the substrate obtained in the aforementioned step was preheated to 80° C. On the burnable intermediate layer of this laminate, the unbaked laminate obtained in (6) above was laminated at an ordinary temperature with a roll laminator while peeling off the polyethylene film, to stack the spacer material layer on the burnable intermediate layer. The air pressure was 3 kg/cm$^2$, and the lamination speed was 1.0 m/min.

(8) Evaluation

The spacer material layer was irradiated with ultraviolet light at an irradiation dose of 300 mJ/cm$^2$ from an ultra-high pressure mercury lamp through a test square pattern mask. Subsequently, the polyethylene terephthalate as the support film was peeled off, and then the layer was subjected to spray development using water at a temperature of 30° C. at a jet pressure of 3 kg/cm$^2$ for 30 seconds to form a pattern. Adhesion and configuration of the resulting pattern were evaluated using a scanning electron microscope. As a result, the resulting minimum line width was 60 micrometers, and no residue of the spacer material layer was observed between the lines of the pattern, indicating that an excellent pattern configuration was obtained.

Further, for evaluating the stability of the configuration of the pattern after being baked, the patterned layers produced in accordance with the above method was subjected to a baking treatment in which the temperature was elevated at an elevation rate of 1.0° C./min and then maintained at 580° C. for 30 minutes. As a result, an excellent baked pattern was obtained. In addition, the bottom surfaces between the lines of the pattern were flat, and no unevenness due to melting of a residue was observed.

Example 2

(1) Preparation of Glass Paste Composition

20 Parts by weight of an isobutyl methacrylate/hydroxyethyl acrylate=80/20 (wt %) copolymer (Mw: 20,000) as an acrylic resin, 20 parts by weight of 3-methoxy-3-methylbutanol as a solvent, and 80 parts by weight of glass frit were mixed and kneaded to prepare a glass paste composition (2) Forming Unbaked Dielectric Layer The glass paste composition obtained was applied to a support film made of removable polyethylene terephthalate film (Trade name: Purex A24, by Teijin DuPont Films Japan Limited) using a lip coater, and the resultant layer was dried at 100° C. for 6 minutes to completely remove the solvent, thus forming an unbaked dielectric layer having a thickness of 60 micrometers on the support film.

(3) Preparation of Composition for Burnable Intermediate Layer

Four parts by weight of polyvinyl alcohol (Trade name: PVA-235, by Kuraray Co., Ltd.), and 53 parts by weight of water and 43 parts by weight of isopropyl alcohol as a solvent were mixed and stirred by a stirrer for 12 hours to prepare a composition for forming a water-soluble burnable intermediate layer.

(4) Formation of Burnable Intermediate Layer

The obtained composition for forming the burnable intermediate layer was applied using a lip coater to the unbaked dielectric layer on the support film obtained in (2) above, and the resultant layer was dried at 100° C. for 6 minutes to completely remove the solvent, thus forming a burnable intermediate layer having a thickness of 0.5 micrometer.

(5) Preparation of Water-Developable Resist Composition

22 Parts by weight of hydroxypropyl cellulose as a water-soluble cellulose derivative, 14 parts by weight of a styrene/hydroxyethyl methacrylate=55/45 (wt %) copolymer (Mw: 40,000) as an acrylic resin, 63 parts by weight of 2-methacryloyloxyethyl 2-hydroxypropyl phthalate (Trade name: HO-MPP, by KYOEISHA CHEMICAL Co., LTD.) as a photopolymerizable monomer, 0.9 part by weight of 2,2-dimethoxy-2-phenylacetophenone (Trade name: IR-651, by Ciba Geigy) as a photopolymerization initiator, 0.1 part by weight of an azo dye (Trade name: Dye SS, by Daito Chemix Corporation) as an ultraviolet light absorber, and 100 parts by weight of 3-methoxy-3-methylbutanol as a solvent were mixed and stirred by a stirrer for 3 hours to prepare a water-developable resist composition.

(5.1) Preparation of Photosensitive Glass Paste Composition

20 Parts by weight of the water-developable resist composition (solid content: 50%) obtained in (5) and 80 parts by weight of glass frit were mixed and kneaded to prepare a water-developable photosensitive glass paste composition.

(6) Formation of Spacer Material Layer

The water-developable photosensitive glass paste composition obtained in (5.1) was applied using a lip coater to the burnable intermediate layer on the support film obtained in (4) above, and the resultant layer was dried at 100° C. for 6 minutes to completely remove the solvent, thus forming a spacer material layer having a thickness of 40 micrometers. Removable polyethylene terephthalate film (Trade name: Purex A53, by Teijin DuPont Films Japan Limited) was then stacked on the spacer material layer to produce an unbaked laminate having a five-layer structure.

(7) Formation of Layers on Glass Substrate

A glass substrate having bus electrodes formed thereon was preheated to 80° C. On the substrate, the unbaked laminate obtained in (6) was laminated at 105° C. with a hot roll laminator while peeling off the removable polyethylene terephthalate film (Purex A24), to stack the unbaked dielectric layer, burnable intermediate layer, and spacer material layer on the glass substrate. The air pressure was 3 kg/cm$^2$, and the lamination speed was 1.0 m/min.

(8) Evaluation

The spacer material layer was irradiated with ultraviolet light at an irradiation dose of 300 mJ/cm$^2$ from an ultra-high pressure mercury lamp through a test square pattern mask. Subsequently, the removable polyethylene terephthalate film (Purex A53) was peeled off, and then the layer was subjected to spray development using water at a temperature of 30° C. at a jet pressure of 3 kg/cm$^2$ for 30 seconds to form a pattern. Adhesion and configuration of the resulting pattern were evaluated using a scanning electron microscope. As a result, the resulting minimum line width was 60 micrometers, and no residue of the spacer material layer was observed between the lines of the pattern, indicating that an excellent pattern configuration was obtained.

Further, for evaluating the stability of the configuration of the pattern after being baked, the patterned layer produced in accordance with the above method was subjected to a baking treatment in which the temperature was elevated at an elevation rate of 1.0° C./min and then maintained at 580° C. for 30 minutes. As a result, an excellent baked pattern was obtained. In addition, the bottom surfaces between the lines of the pattern were flat, and no unevenness due to melting of a residue was observed.

Example 3

Four parts by weight of hydroxymethyl cellulose (Trade name: Metolose 65S-400, by Shin-Etsu Chemical Co., Ltd.), and 50 parts by weight of water and 46 parts by weight of methanol as a solvent were mixed and stirred by a stirrer for 12 hours, to prepare a composition for forming a water-soluble burnable intermediate layer. Except that this composition for the intermediate layer was employed in place of the composition for the intermediate layer in Example 1, pattern formation and evaluation thereof were performed in the same way as in Example 1. As a result, the resulting minimum line width was 60 micrometers, and no residue of the spacer material layer was observed between the lines of the pattern, indicating that an excellent pattern configuration was obtained.

Further, for evaluating the stability of the configuration of the pattern after being baked, the patterned layer produced in accordance with the above method was subjected to a baking treatment in which the temperature was elevated at an elevation rate of 1.0° C./min and then maintained at 580° C. for 30 minutes. As a result, an excellent baked pattern was obtained. In addition, the bottom surfaces between the lines of the pattern were flat, and no unevenness due to melting of a residue was observed.

Example 4

10 parts by weight of a butyral resin (Trade name: S-LEC BX-L, by Sekisui Chemical Co., Ltd.) was dissolved in 90 parts by weight of methanol, to obtain a solution. This solution was then mixed with 125 parts by weight of the composition for the burnable intermediate layer obtained in Example 2 and stirring by a stirrer for 12 hours, to form a composition for forming a water-swellable burnable intermediate layer. Except that this composition for the intermediate layer was employed in place of the composition for the intermediate layer in Example 1, pattern formation and evaluation thereof were performed in the same way as in Example 1. As a result, the resulting minimum line width was 60 micrometers, and no residue of the spacer material layer was observed between the lines of the pattern, indicating that an excellent pattern configuration was obtained.

Further, for evaluating the stability of the configuration of the pattern after being baked, the patterned layer produced in accordance with the above method was subjected to a baking treatment in which the temperature was elevated at an elevation rate of 1.0° C./min and then maintained at 580° C. for 30 minutes. As a result, an excellent baked pattern was obtained. In addition, the bottom surfaces between the lines of the pattern were flat, and no unevenness due to melting of a residue was observed.

Comparative Example 1

(1) Preparation of Glass Paste Composition

20 Parts by weight of an isobutyl methacrylate/hydroxyethyl acrylate=80/20 (wt %) copolymer (Mw: 20,000) as an acrylic resin, 20 parts by weight of 3-methoxy-3-methylbutanol as a solvent, and 80 parts by weight of glass frit were mixed and kneaded to prepare a glass paste composition.

(2) Formation of Unbaked Dielectric Layer

The glass paste composition obtained was applied to a support film made of polyethylene terephthalate using a lip coater, and the resultant layer was dried at 100° C. for 6 minutes to completely remove the solvent, thus forming an unbaked dielectric layer having a thickness of 60 micrometers on the support film. A polyethylene film having a thickness of 25 micrometers was then stacked on the unbaked dielectric layer to produce an unbaked laminate for transferring the unbaked dielectric layer.

(3) Preparation of Water-Developable Resist Composition

22 Parts by weight of hydroxypropyl cellulose as a water-soluble cellulose derivative, 14 parts by weight of a styrene/hydroxyethyl methacrylate=55/45 (wt %) copolymer (Mw: 40,000) as an acrylic resin, 63 parts by weight of 2-methacryloyloxyethyl 2-hydroxypropyl phthalate (Trade name: HOMPP, by KYOEISHA CHEMICAL Co., LTD.) as a photopolymerizable monomer, 0.9 part by weight of 2,2-dimethoxy-2-phenylacetophenone (Trade name: IR-651, by Ciba Geigy) as a photopolymerization initiator, 0.1 part by weight of an azo dye (Trade name: Dye SS, by Daito Chemix Corporation) as an ultraviolet light absorber, and 100 parts by weight of 3-methoxy-3-methylbutanol as a solvent were mixed and stirred by a stirrer for 3 hours to prepare a water-developable resist composition.

(3.1) Preparation of Photosensitive Glass Paste Composition

20 Parts by weight of the water-developable resist composition (solid content: 50%) obtained in (3) and 80 parts by weight of glass frit were mixed and kneaded to prepare a water-developable photosensitive glass paste composition.

(4) Formation of Spacer Material Layer

The water-developable photosensitive glass paste composition obtained in (3.1) was applied to a support film made of polyethylene terephthalate using a lip coater, and the resultant layer was dried at 100° C. for 6 minutes to completely remove the solvent, thus forming a spacer material layer having a thickness of 40 micrometers on the support film. A polyethylene film having a thickness of 25 micrometers was then stacked on the spacer material layer to produce an unbaked laminate for transferring the spacer material layer.

(5) Formation of Layers on Glass Substrate

A glass substrate having bus electrodes formed thereon was preheated to 80° C. On the substrate, the unbaked laminate obtained in (2) was laminated at 105° C. by a hot roll laminator while peeling off the polyethylene film, to stack the unbaked dielectric layer on the glass substrate. The air pressure was 3 kg/cm$^2$, and the lamination speed was 1.0 m/min. Subsequently, the polyethylene terephthalate film as the support film was peeled off.

The unbaked dielectric layer obtained in (5) above was then preheated to 80° C. On the surface of the unbaked dielectric layer, the unbaked laminate obtained in (4) was laminated at an ordinary temperature with a roll laminator while peeling off the polyethylene film, to stack the spacer material layer on the unbaked dielectric layer. The air pressure was 3 kg/cm$^2$, and the lamination speed was 1.0 m/min.

(6) Evaluation

The spacer material layer was irradiated with an ultraviolet light at an irradiation dose of 300 mJ/cm$^2$ from an ultra-high pressure mercury lamp through a test square pattern mask. Subsequently, the polyethylene terephthalate as the support film was peeled off, and then the layer was subjected to spray development using water at a temperature of 30° C. at a jet pressure of 3 kg/cm$^2$ for 30 seconds to form a pattern. Adhesion and configuration of the resulting pattern were evaluated using a scanning electron microscope. As a result, the resulting minimum line width was 60 micrometers and an excellent pattern form was obtained. However, a slight residue of the spacer material layer was observed between the lines of the pattern.

Further, for evaluating the stability of the configuration of the pattern after being baked, the patterned layer produced in accordance with the above method was subjected to a baking treatment in which the temperature was elevated at an elevation rate of 1.0° C./min and then maintained at 580° C. for 30 minutes. As a result, the bottom surfaces between the lines of the pattern were not flat.

As explained above, with the present invention, an intermediate layer, which is water-soluble or water-swellable and which is capable of completely burning up in a burning treatment, may be formed between the unbaked dielectric layer and the unexposed, photosensitive unbaked spacer material layer, and the burnable intermediate layer may be dissolved in or swollen with water upon washing the pattern with water after or simultaneously with the development of the exposed spacer material layer. Therefore, the spacer layer remaining in the region that has been subjected to the removing development can be easily removed, so that the thickness of the region subjected to the removing development becomes uniform, thus making it possible to produce a front plate of a plasma display device having uniform discharge properties and light transmittance.

REFERENCES

1. Japanese Patent Application Laid-open No. 2002-150949
2. Japanese Patent Application Laid-open No. 2002-328467

The invention claimed is:

1. An unbaked laminate for producing a front plate of a plasma display device having a glass substrate having a surface on which electrodes are formed, a dielectric layer formed on said surface, and spacer layers formed on said dielectric layer, said laminate consisting of:

a removable support film;

a photosensitive unbaked spacer material layer formed on said removable support film; and a burnable intermediate layer formed on said spacer material layer, said intermediate layer being water-soluble or water-swellable.

2. The unbaked laminate according to claim 1, wherein said spacer material layer consists of a photosensitive glass paste material which is capable of being developed by the use of water.

3. The unbaked laminate according to claim 1, wherein said burnable intermediate layer comprises a resin selected from the group consisting of a polyvinyl alcohol, a polyvinyl alcohol derivative, a water-soluble cellulose, and mixtures thereof.

4. The unbaked laminate according to claim 1, wherein said burnable intermediate layer has a thickness of 5 micrometers or less.

5. An unbaked laminate for producing a front plate of a plasma display device having a glass substrate having a surface on which electrodes are formed, a dielectric layer formed on said surface, and spacer layers formed on said dielectric layer, said laminate comprising:

a removable support film;

a photosensitive unbaked spacer material layer formed on said removable support film;

a burnable intermediate layer formed on said spacer material layer, said intermediate layer being water-soluble or water-swellable; and a non-photosensitive unbaked dielectric layer formed on said burnable intermediate layer, said dielectric layer consisting of a glass paste material.

6. the unbaked laminate according to claim 5, wherein said spacer material layer consists of photosensitive glass paste material which is capable of being developed by the use of water.

7. The unbaked laminate according to claim 5, further comprising a removable protection film covering a surface of said laminate, said surface being on the other side of said removable support film.

8. The unbaked laminate according to claim 5, wherein said burnable intermediate layer comprises a resin selected from the group consisting of a polyvinyl alcohol, a polyvinyl alcohol derivative, a water-soluble cellulose, and mixture thereof.

9. The unbaked laminate according to claim 5, wherein said burnable intermediate layer has a thickness of 5 micrometers or less.

10. A method for producing a front plate of a plasma display device having a glass substrate having a surface on which electrodes are formed, a dielectric layer formed on said surface, and spacer layers formed on said dielectric layer, said method comprising the steps of:

(a) forming on said surface of the substrate a non-photosensitive unbaked dielectric layer consisting of a glass paste material, a burnable intermediate layer which is water-soluble or water-swellable, and a photosensitive unbaked spacer material layer in this order;

(b) irradiating said spacer material layer with a patterning light, and developing said spacer material layer, to constitute a patterned spacer material layer;

(c) baking said non-photosensitive unbaked dielectric layer, said burnable intermediate layer, and said patterned spacer material layer simultaneously, to burn up said burnable intermediate layer and forming said dielectric layer and said spacer layers on said glass substrate simultaneously.

11. The method for producing the front plate of the plasma display device according to claim 10, wherein said step (a) comprises:

forming on a removable support film a burnable intermediate layer which is water-soluble or water-swellable, and said unbaked dielectric layer consisting of a glass paste material in this order to prepare a laminate;

attaching said laminate on said glass substrate so that said unbaked dielectric layer faces said surface of said glass substrate, said surface having said electrodes;

removing said removable support film from said burnable intermediate layer, to uncover said burnable intermediate layer; and forming a photosensitive unbaked spacer material layer on said burnable intermediate layer.

12. The method for producing the front plate of the plasma display device according to claim 10, wherein said step (a) comprises:

forming on a removable support film a photosensitive unbaked spacer material layer, and a burnable intermediate layer which is water-soluble or water-swellable in this order to prepare a laminate;

forming said non-photosensitive unbaked dielectric layer consisting of a glass paste material on the surface of said glass substrate, said surface having said electrodes; and attaching said laminate on said unbaked dielectric layer so that said burnable intermediate layer faces said unbaked dielectric layer.

13. The method for producing the front plate of the plasma display device according to claim 10, wherein said step (a) comprises:

forming on a removable support film a photosensitive unbaked spacer material layer, a burnable intermediate layer which is water-soluble or water-swellable, and said unbaked dielectric layer consisting of a glass paste material in this order to prepare a laminate; and attaching said laminate on said glass substrate so that said unburned dielectric layer faces the surface of said glass substrate, said surface having said electrodes.

14. An unbaked laminate for producing a front plate of a plasma display device having a glass substrate having a surface on which electrodes are formed, a dielectric layer formed on said surface, and spacer layers formed on said dielectric layer, said laminate consisting of:

a removable support film;

a photosensitive unbaked spacer material layer formed on said removable support film;

a burnable intermediate layer formed on said spacer material layer, said intermediate layer being water-soluble or water-swellable; and a removable protection film covering a surface of said laminate, said surface being on the other side of said removable support film.

* * * * *